US005480759A

United States Patent [19]

Kasuya et al.

[11] Patent Number: 5,480,759

[45] Date of Patent: Jan. 2, 1996

[54] TONER IMAGE TRANSFER METHOD

[75] Inventors: Takashige Kasuya, Sohka; Noboru Kashimura; Tatsuya Nakamura, both of Tokyo; Tatsuhiko Chiba, Kamakura; Kohji Inaba, Yokohama, all of Japan

[73] Assignee: Canon Kabushiki Kaisha, Tokyo, Japan

[21] Appl. No.: 425,355

[22] Filed: Apr. 19, 1995

Related U.S. Application Data

[63] Continuation of Ser. No. 267,655, Jun. 29, 1994, abandoned.

[30] Foreign Application Priority Data

Jun. 29, 1993 [JP] Japan ..... 5-182208
Jul. 23, 1993 [JP] Japan ..... 5-202037

[51] Int. Cl.[6] ..... G03G 13/22; G03G 13/16

[52] U.S. Cl. ..... 430/126; 430/58; 430/66; 430/67; 430/111

[58] Field of Search ..... 430/66, 111, 126

[56] References Cited

U.S. PATENT DOCUMENTS

| | | | |
|---|---|---|---|
| 2,860,048 | 11/1958 | Deubner | 430/67 |
| 4,895,783 | 1/1990 | Lee et al. | 430/66 |
| 5,041,350 | 8/1991 | Yagi | 430/66 X |
| 5,153,086 | 10/1992 | Yagi et al. | 430/66 X |
| 5,242,777 | 9/1993 | Kato et al. | 430/111 X |
| 5,288,583 | 2/1994 | Osumi et al. | 430/126 |

FOREIGN PATENT DOCUMENTS

| | | |
|---|---|---|
| 0424952 | 5/1991 | European Pat. Off. . |
| 0488413 | 6/1992 | European Pat. Off. . |
| 36-4121 | 4/1961 | Japan . |
| 38-15446 | 8/1963 | Japan . |
| 41-16429 | 9/1966 | Japan . |
| 42-19747 | 10/1967 | Japan . |
| 42-23910 | 11/1967 | Japan . |
| 43-24748 | 10/1968 | Japan . |
| 46-3713 | 1/1971 | Japan . |
| 54-143645 | 11/1979 | Japan . |

OTHER PUBLICATIONS

Patent Abstracts of Japan, vol. 13, No. 64 (P–827) (3412) Feb. 1989.

Database WPI, Week 8416, Derwent Publ., AN 84–098188 [16].

Patent Abstracts of Japan, vol. 14, No. 349 (P–1084) [4292] Jul. 1990.

Patent Abstracts of Japan, vol. 15, No. 430 (P–1270) Oct. 1991.

*Primary Examiner*—Roland Martin

*Attorney, Agent, or Firm*—Fitzpatrick, Cella, Harper & Scinto

[57] ABSTRACT

An electrophotographic toner showing a good fixability onto recording paper is constituted by at least a binder resin and a colorant, the binder resin comprising a resin component having a polar group, the binder resin having a molecular weight distribution according to gel permeation chromatography including a peak in a molecular weight region of $5\times10^3$–$5\times10^4$. The toner is used to develop an electrostatic image formed on a electrophotographic photosensitive member including at least an electroconductive support, a charge generation layer and a charge transport layer, and the resultant toner image is transferred onto a recording medium without difficulties such as occurrence of cracks on the photosensitive member or inferior transferability by using a photosensitive member having a surface layer containing a transition metal atom at 0.1–10 ppm. The surface of the photosensitive member may preferably show a fluorine atom/carbon atom (F/C) ratio or/and a silicon atom/carbon atom (Si/C) ratio, respectively, of 0.03–1.0 as measured by X-ray photoelectron spectroscopy.

44 Claims, 1 Drawing Sheet

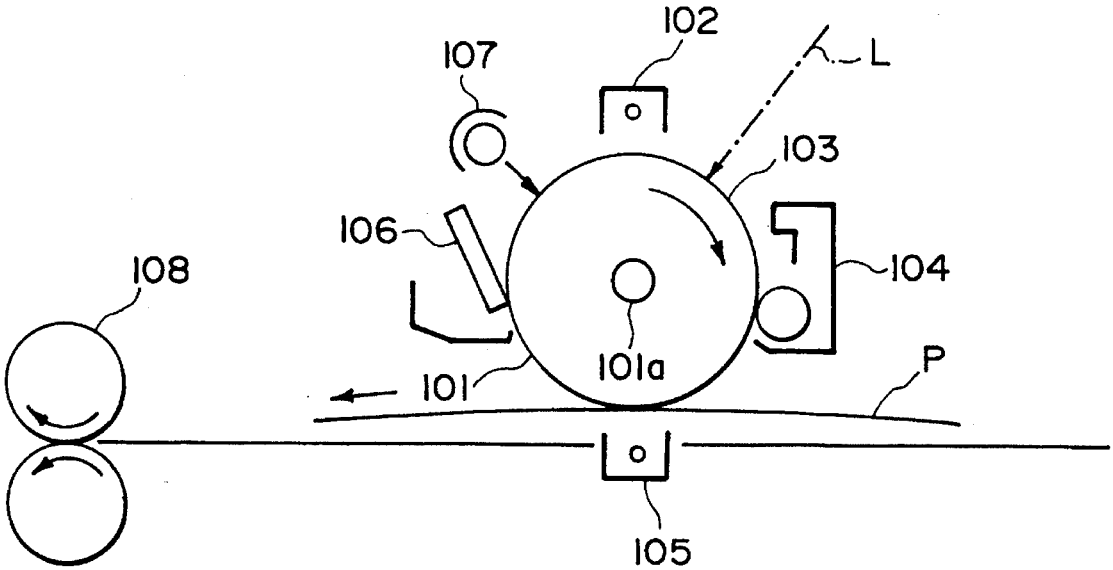
102
107
L
103
106
104
108
101a
101
P
105

TONER IMAGE TRANSFER METHOD

This application is a continuation of application Ser. No. 08/267,655 filed Jun. 29, 1994, now abandoned.

FIELD OF THE INVENTION AND RELATED ART

The present invention relates to an image forming method using an electrophotographic photosensitive member and a toner.

Various forms of electrophotographic photosensitive members are used so as to obtain desired characteristics depending on the electrophotographic processes used. Typical electrophotographic photosensitive members include one having a photoconductor layer as an image bearing layer on a substrate, and one having laminar layers as an image bearing layer including a photoconductor layer and an insulating layer thereon disposed on a substrate. The photosensitive member comprising a photoconductor layer on a substrate may be used in an electrophotographic process including a charging step, an exposure step and a developing step, and optionally a transfer step.

The insulating layer disposed on a type of photosensitive member is provided of various purposes, such as protection of the photoconductor layer, an improvement in mechanical strength of the photosensitive member, an improvement in dark attenuation characteristic, and application to a specific electrophotographic process.

Typical examples of such a photosensitive member having an insulating layer and an electrophotographic process using such a photosensitive member having an insulating layer are described in, e.g., U.S. Patent No. 2,860,048, and Japanese Patent Publication (JP-B) 41-16429, JP-B 38-15446, JP-B 46-3713, JP-B 42-23910, JP-B 43-24748, JP-B 42-19747, and JP-B 36-4121.

An electrophotographic photosensitive member is required to exhibit prescribed sensitivity, electric characteristic and further optical characteristic depending on the electrophotographic process to which the photosensitive member is applied. Moreover, the photosensitive member is required to exhibit a durability as an important property. It is difficult to obtain stably clear images under various environmental conditions by using a photosensitive member which exhibits a remarkably lower surface potential under a high-humidity condition even if it exhibits excellent electrophotographic characteristics. In an electrophotographic process including a transfer step, the photosensitive member is generally used repetitively, so that the surface substance is liable to be damaged due to breakage of chemical bond, and the surface resistivity is liable to be lowered due to attack of ionized oxygen, ozone, moisture, etc., thus being liable to cause a lowering in static charge retention power of the photosensitive member and a deterioration of image sharpness particularly in a high-humidity environment. It is also possible that substances attached to the photosensitive member, such as paper dust, lower the charge-retention power of the photosensitive member, thus causing image flow.

The surface of a photosensitive member is generally covered with a resin, so that the properties of the resin are important, and a resin having purpose, there has been proposed to use a polycarbonate resin having a skeleton of bisphenol A (hereinafter referred to as bisphenol A-type polycarbonate) as a binder resin constituting the surface layer.

Polycarbonate resin as an engineering plastic, however, generally has a large surface free energy, so that a toner is liable to attach to the surface thereof. For this reason, when a photosensitive member comprising polycarbonate resin on the surface is used for formation of a wholly black image (referred to as a solid black image), a large number of white spots are liable to occur as image defects.

Further, a photosensitive member may be formed by applying a solution of a binder resin and a charge transport agent in a solvent onto a substrate, followed by drying, to form a film on the substrate. A film formed in this manner retains a residual strain stress in its internal structure. Polycarbonate resin has such a tendency strongly and is liable to cause a solvent crack in the resultant coating film when used as the binder resin. In case where the thus formed photosensitive member is loaded in an electrophotographic apparatus, the photosensitive member is liable to cause cracks leading to defective images, when it is touched with human hands, or oils or low-molecular weight organic compounds used in the apparatus.

Further, if the photosensitive member has a large friction coefficient, a large degree of wearing is caused thereby in case where the photosensitive member surface is cleaned by, e.g., urethane rubber blade, so that it is difficult to obtain a large number of sheets in a continuous operation in some cases.

A typical toner used in electrophotography is a pulverization toner which may be prepared through a process wherein a colorant of a dye or pigment is melt-kneaded with a thermoplastic resin for uniform dispersion, and the mixture is finely pulverized and classified to recover a toner having a prescribed particle size.

Another type of toner is a polymerization toner obtained by suspension polymerization or emulsion polymerization. A polymerization toner according to suspension polymerization may be produced through a process wherein a monomer composition including a polymerizable monomer, a colorant, a polymerization initiator and, optionally, a crosslinking agent, a charge controller, and other additives in a solution or dispersion state is dispersed in a continuous medium, such as water, containing a dispersing agent under the action of a stirrer, simultaneously with polymerization, to obtain toner particles having a prescribed size.

In the toner production process according to polymerization, no pulverization step is involved, so that the toner particles need not be fragile but can contain a soft material. Further, there arise advantages such that the colorant is not exposed to the surface of toner particles and the toner can have a uniform triboelectric chargeability. In the polymerization toner production, there is even a possibility of omitting the classification step, so that it is also excepted to effect economization of energy consumption, shortening of production time and increase in toner yield, leading to a large cost reduction.

In recent years, an electrophotographic toner having a low-temperature fixability is required for the purpose of energy economization. For this requirement, a toner binder resin showing a good wettability with and a good fixability onto paper is selected in recent years. Further, a toner is also designed to show melt viscosity characteristics including a low viscosity at a low temperature.

When such a toner is used, however, a low-temperature fixation may be achieved, but such a toner shows an increased tendency of attachment onto the photosensitive member, thus being liable to result in difficulties, such as cleaning failure, worse transfer characteristic, and further toner sticking onto the photosensitive member, leading to deterioration in image quality.

SUMMARY OF THE INVENTION

An object of the present invention is to provide an image forming method having solved the above-mentioned problems.

A more specific object of the present invention is to provide an image forming method whereby high-quality images are obtained stably while suppressing the deterioration of the photosensitive member.

Another object of the present invention is to provide an image forming method using a toner having excellent fixability, and a photosensitive member excellent in transfer performance and cleaning performances.

According to the present invention, there is provided an image forming method, comprising:

forming an electrostatic image on an electrophotographic photosensitive member, the electrophotographic photosensitive member comprising at least an electroconductive support, a charge generation layer and a charge transparent layer, the electrophotographic photosensitive member having a surface layer containing a transition metal atom at 0.1–10 ppm, developing the electrostatic image to form a toner image on the electrophotographic photosensitive member (on a weight basis), transferring the toner image onto a transfer-receiving medium, and removing a residual toner from the electrophotographic photosensitive member;

wherein the toner comprises at least a binder resin and a colorant, the binder resin comprising a resin component having a polar group, the binder resin having a molecular weight distribution according to gel permeation chromatography including a peak in a molecular weight region of $5\times10^3$–$5\times10^4$.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE in the drawing is a schematic illustration of an image forming apparatus for practicing an embodiment of the image forming method according to the present invention.

DETAILED DESCRIPTION OF THE INVENTION

As result of our study, it has been found effective to use a toner binder resin (toner-constituting resin) having a molecular weight distribution (as measured by GPC (gel permeation chromatography)) including a main peak in a molecular weight region of $5\times10^3$–$5\times10^5$, the binder resin comprising at least one resin component having a polar group. As a result, the toner containing such a resin having a polar group having good affinity with paper provides a large attachment with paper.

On the other hand, such a resin component having a polar group is liable to attach to a photosensitive member surface, and a low-molecular weight fraction of the resin component having a polar group and wax attached to the photosensitive member surface are liable to cause cracks in the photosensitive member surface.

However, as a result of our study for suppressing the deterioration of the photosensitive member to stably provide high-quality images, it has been also found effective for such purpose to provide the electrophotographic photosensitive member with a surface layer containing 0.1–10 ppm (by weight) of a transition metal atom.

A transition metal atom content of below 0.1 ppm is insufficient to suppress the occurrence of cracks in the photosensitive member due to the resin component having a polar group in the toner. A content of above 10 ppm provides no problem regarding the crack-suppressing effect but is liable to cause leakage of charge, thus being liable to deteriorate the charging characteristic of the photosensitive member.

The transition metal atom may preferably be selected from iron (Fe), nickel (Ni) and chromium (Cr).

It is sufficient that the photosensitive member contains a transition metal atom in its outermost layer, and the form of presence and addition thereof need not be restricted particularly. The content of the transition metal atom in the surface layer may be measured by atomic absorption spectrometry.

In the present invention, the toner exhibits excellent low-temperature fixability because the toner binder resin has a molecular weight distribution according to GPC including a main peak in a molecular weight region of $5\times10^3$–$5\times10^4$.

If the main peak in the GPC molecular weight distribution of a toner is below $5\times10^3$ the toner is liable to have an inferior anti-blocking characteristic. On the other hand, in case where no peak is present in the molecular weight range of $5\times10^3$–$5\times10^4$ but a main peak is present at a molecular weight exceeding $5\times10^4$ the low-temperature fixability becomes inferior. A particularly good fixability is exhibited if a resin component having a molecular weight of at most $10^5$ occupies at least 50%.

In the present invention, the molecular weight distribution of the toner binder resin may be measured by GPC using THF (tetrahydrofuran) as the solvent as follows.

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and plotted on a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P available from Showa Denko K.K.; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

A GPC sample is prepared as follows. A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 micron (e.g., "Maishoridisk H-25-5", available from Toso K. K.; and "Ekikurodisk 25CR", available from German Science Japan K.K.) to recover the filtrate as a GPC sample. The sample concentration is adjusted to provide a resin concentration within the range of 0.5–5 mg/ml.

The resin component having a polar group in the toner used in the present invention may include, for example: polymers of a nitrogen-containing monomer, such as dimethylaminoethylmethacrylate, and diethylaminoethyl methacrylate, and copolymers of such a nitrogen-containing monomer and another monomer, such as styrene or an unsaturated carboxylic acid ester; polymers or copolymers with another monomer, such as a styrene-type monomer, of polar monomers inclusive of nitrile monomers such as acrylonitrile, halogenide monomers such as vinyl chloride, unsaturated carboxylic acids such as acrylic acid and methacrylic acid, unsaturated dibasic acids, unsaturated dibasic acid anhydrides and nitro-substituted monomers; polyester resins; and epoxy resins. Examples of the polar group may include: carboxyl group, acid anhydride group, amino group, substituted amino group, nitrile group, nitro group, and epoxy group.

The resin component having a polar group may be incorporated in the toner particles in the following manner.

In the case of a polymerization toner produced directly by suspension polymerization or emulsion polymerization, a polymer or copolymer having a polar group, such as carboxyl group, acid anhydride group, amino group, substituted-amino group, nitrile group or nitro group, may be dissolved in a polymerizable monomer, such as styrene monomer, which is subjected to polymerization to form toner particles containing the resin component having a polar group. Alternatively, it is also possible to form a polymerizable monomer composition as a mixture of a polymerizable monomer having a polar group and another monomer, such as styrene monomer, and polymerize the monomer composition to produce toner particles containing the resin component having a polar group as produced by the polymerization.

In the case of a pulverization toner, the polymer or copolymer having a polar group alone or in mixture with another polymer or copolymer is blended with a colorant, followed by melt-kneading, pulverization and classification to produce polymer particles containing the resin component (i.e., polymer or copolymer) having a polar group.

The polymerization toner and the pulverization toner may comprise a binder resin produced from a polymerizable monomer, examples of which may include: styrene and its derivatives such as styrene, o-methylstyrene, m-methylstyrene, p-methylstyrene, p-methoxystyrene, and p-ethylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate and phenyl methacrylate. These monomers may be used singly or in mixture of two or more species. These monomers may be used singly or in mixture of two or more species for producing the binder resin. Among the above monomers, styrene or its derivatives may preferably be used singly or in mixture with another monomer so as to provide a toner showing good developing characteristic and durability.

The polymerization toner used in the present invention may be produced in the following manner. Into a polymerizable monomer, a release agent, a colorant, a charge control agent, a polymerization initiator and another optional additive are added and uniformly dissolved or dispersed by a dispersing means, such as a homogenizer or an ultrasonic dispersing device, to form a polymerizable monomer composition, which is then dispersed and formed into particles in a dispersion medium containing a dispersion stabilizer or an emulsifier by means of a stirrer, homomixer or homogenizer. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a later stage of the polymerization. It is also possible to subject a part of the aqueous system to distillation in a later stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer mixture.

Examples of the polymerization initiator usable in the present invention may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The polymerization initiator may generally be used in the range of about 0.5–20 wt. % based on the weight of the polymerizable monomer. The polymerization initiators may be used singly or in mixture.

In order to control the molecular weight of the resultant binder resin, it is also possible to add a crosslinking agent or a chain transfer agent in a proportion of preferably 0.001–15 wt. %.

In production of the polymerization toner by polymerization in an aqueous medium, it is preferred to use an inorganic or/and an organic dispersion stabilizer in the dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium.

In order to effect fine dispersion of the dispersion stabilizer, it is also effective to use 00.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The colorant used in the present invention may be known ones, examples of which may include: carbon black; dyes, such as C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid blue 15, C.I. Basic Blue 3, C.I. Basic Blue 5, C.I. Mordant Blue 7, C.I. Direct Green 6, C.I. Basic Green 4, and C.I. Basic Green 6; and pigments, such as Chrome Yellow, Cadmium Yellow, Mineral Fast Yellow, Navel Yellow, Naphthol Yellow S, Hansa Yellow G, Permanent Yellow NCG, Tartrazine Lake, Molybdenum Orange, Permanent Orange GTR, Benzidine Orange G, Cadmium Red, Permanent Red 4R, Watchung Red Ca salt, Brilliant Carmine 3B, Fast Violet B, Methyl Violet Lake, Ultramarine, Cobalt Blue, Alkali Blue Lake, Victoria Blue Lake, quinacridone, Rhodamine Lake, Phthalocyanine Blue, Fast Sky Blue, Pigment Green B, Malachite Green Lake, and Final Yellow Green G.

Regarding the colorant to be used for toner production directly by polymerization, it is necessary to pay attention to the polymerization-inhibiting function and transferability to the aqueous phase of the colorant. Accordingly, it is preferred to use the above-mentioned colorant after surface modification. For example, it is appropriate to hydrophobise the colorant so as not to inhibit the polymerization. Particularly, many dyes and carbon black can inhibit the polymerization, so that attention should be paid. As a preferred method of surface-treating a dye, a monomer may be polymerized in advance in the presence of the dye. The resultant colored polymer may be added to the polymerizable monomer mixture. Carbon black can be treated in the same manner as the dye and can also be treated with a substance capable of in reacting with the surface-functional group of the carbon black, such as polyorganosiloxane.

In the case of a magnetic toner, the toner particles are caused to contain magnetic powder. The magnetic powder comprises a substance magnetizable when placed in a magnetic field. Examples of such a substance may include: ferromagnetic metals, such as iron, cobalt and nickel, and compounds, such as magnetite and ferrite. In the case of toner production by polymerization, it is necessary to pay attention to the polymerization-inhibiting function and transferability to the aqueous phase of the magnetic material. Accordingly, it is preferred to subject the magnetic material to surface modification, e.g., a hydrophobicity imparting treatment with a substance not exhibiting a polymerization-inhibiting function.

In order to improve the releasability at the time of hot roller fixation, it is possible to incorporate a wax inclusive of a waxy hydrocarbon compound as a release agent. Examples of such waxes may include: paraffins, polyolefin waxes, and modified products thereof inclusive of oxidized products and grafted products, higher fatty acids and metal salts, amide wax, and natural or synthetic ester waxes. It is preferred to use a wax having a softening point of 40°–130° C., more preferably 50°–120° C., as measured by the ring and ball method (JIS K-2531). A softening point of below 40° C. is liable to provide a toner having inferior anti-blocking characteristic and shape-retaining characteristic. In excess of 130° C., the resultant toner is provided with only a low releasability. The waxes may be added singly or in combination in a proportion of 0.1–50 wt. %.

In the present invention, it is preferred to incorporate a charge control agent in the toner-producing materials so as to control the chargeability of the resultant toner. It is preferred to use a charge control agent substantially free from polymerization-inhibiting property or transferability to aqueous phase. Examples of preferred positive charge control agents may include: nigrosine dyes, triphenylmethane dyes, quaternary ammonium salts, guanidine derivatives, imidazole derivatives, and amine and polyamine compounds. Examples of the negative charge control agents may include: metal-containing salicyclic acid-based compounds, metal-containing monoazo dyes, urea derivatives, styrene-acrylic acid copolymer and styrene-methacrylic acid copolymer.

The charge control agent may preferably be contained in a proportion of 0.1–10 wt. %.

The polymerization toner used in the present invention may be prepared by melt-kneading resin components (inclusive of a binder resin comprising a resin component having a polar group), a colorant, and optional components, such as a charge control agent and a release agent, cooling the kneaded product, pulverizing the cooled kneaded product, and classifying the pulverized product.

Additives optionally added to a toner for imparting various characteristics may preferably have a particle size which is at most 1/10 of the volume-average particle size of the toner particles in view of the long term successive image formation performances of the toner when such additives are internally or externally added to the toner particles. Herein, the particle size of an additive refers to an average particle size when the surface states of toner particles are observed through an electron microscope. Examples of the optional additives added to a toner for imparting various characteristics may include the following:

1) Flowability imparting agents, such as metal oxides inclusive of silicon oxide, aluminum oxide and titanium oxide, carbon black, and fluorinated carbon. These materials may preferably be subjected to a hydrophobicity-imparting treatment.
2) Abrasives, inclusive of: metal oxides such as strontium titanate, cerium oxide, aluminum oxide, magnesium oxide, and chromium oxide; nitrides, such as silicon nitride; carbide, such as silicon carbide; and metal salts, such as calcium sulfate, barium sulfate and calcium carbonate.
3) Lubricants, inclusive of: powder of fluorine-containing resins, such as polyvinylidene fluoride, and polytetrafluoroethylene; and aliphatic acid metal salts, such as zinc stearate, and calcium stearate.
4) Charge-controlling particles, inclusive of: particles of metal oxides, such as tin oxide, titanium oxide, zinc oxide, silicon oxide, and aluminum oxide, and carbon black.

These additives may be added in a proportion of 0.1–10 wt. parts, preferably 0.1–5 wt. parts, per 100 wt. parts of the toner particles. These additives may be used singly or in combination of plural species.

Next, the electrophotographic photosensitive member used in the present invention will be described.

In the present invention, the surface layer of the photosensitive member refers to a layer disposed closer to the surface than a charge generation layer.

The photosensitive member may preferably have a layer structure including a charge generation layer and a charge transport layer disposed on an electroconductive substrate. In the present invention, the charge transport layer can be further covered with a protective layer to form the surface layer in combination.

In order to more effectively accomplish the object of the present invention, it is preferred that the charge transport layer, the protective layer or both of them comprises a polycarbonate resin. In the present invention, it is further preferred that the polycarbonate resin is one synthesized from an asymmetrical diol.

The polycarbonate resin used as a binder resin of the charge transport layer and/or the protective layer may preferably be one that is soluble in an aromatic hydrocarbon solvent and/or a halogenated aromatic hydrocarbon solvent and has a low crystallinity. More specifically, such a polycarbonate resin may be produced by an ordinary polycarbonate synthesis process, such as the phosgene process using 1) bisphenol A and one or more asymmetrical diol compounds, or 2) one or more asymmetrical diol compounds. It is also possible to obtain a desired polycarbonate resin by using a diol compound having a substituent group including 3 or more carbon atoms in its side chain.

Representative examples of the asymmetrical diol compound may include the following, but they are not exhaustive.

(1)

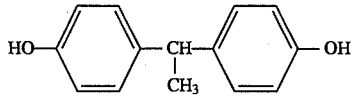

(2)

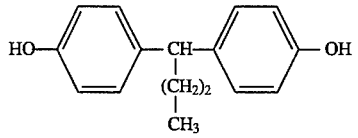

(3)

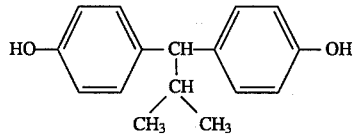

(4)

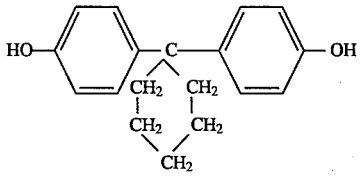

(5)

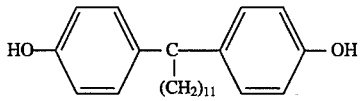

-continued (6)

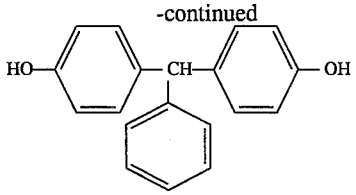

(7)

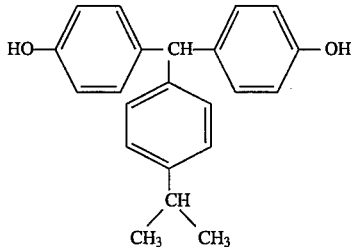

(8)

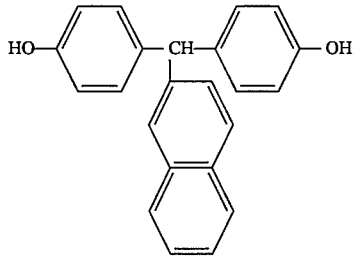

(9)

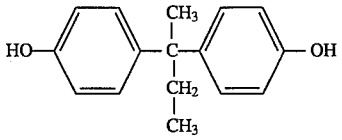

(10)

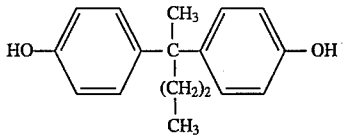

(11)

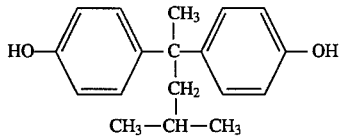

(12)

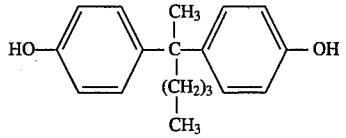

(13)

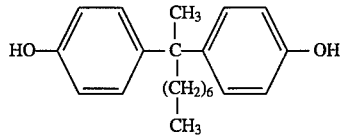

-continued (14)

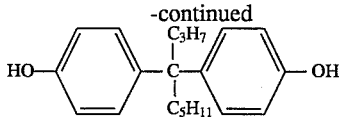

(15)

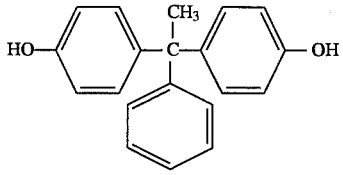

(16)

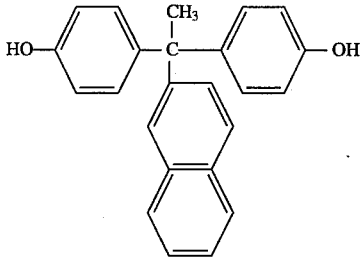

(17)

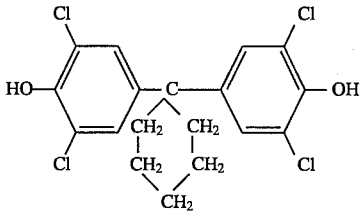

(18)

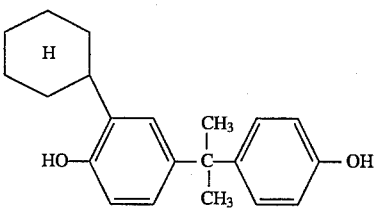

(19)

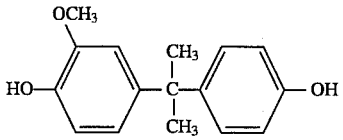

(20)

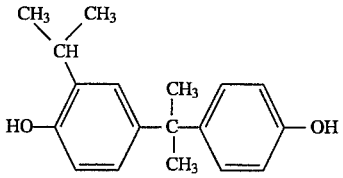

(21)

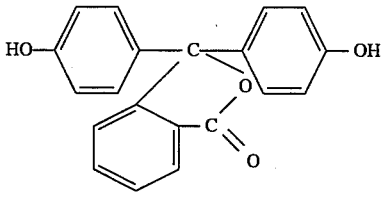

(22)

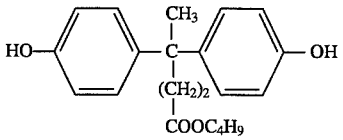

-continued (23)

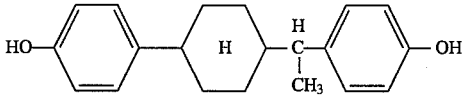

(24)

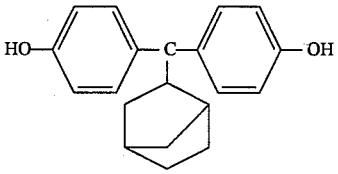

(25)

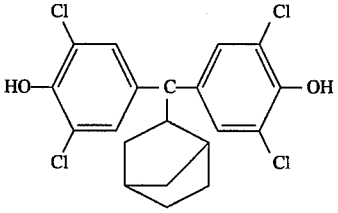

(26)

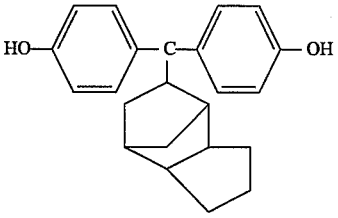

(27)

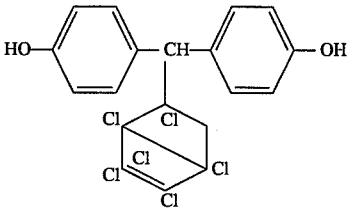

(28)

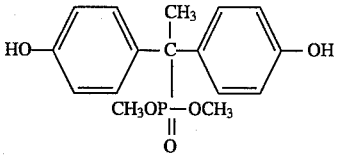

(29)

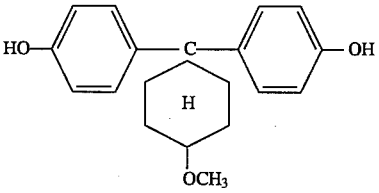

In the above-mentioned system using diol compounds including bisphenol A and asymmetrical diol for producing a polycarbonate copolymer, the asymmetrical diol compound may preferably constitute at least 20 wt. %, more preferably at least 50 wt. %, of the diol compounds. If the proportion of the asymmetrical diol compound is below 20 wt. %, the resultant polycarbonate resin is caused to have a low solubility in a hydrocarbon solvent or a halogenated aromatic hydrocarbon solvent, and the coating solution is liable to have a low stability with time. The polycarbonate resin may preferably have a solubility at 25° C. of at least 1 g/100 g-solution, more preferably at least 5 g/100 g-solution, in such a solvent. If the solubility is below 1 g/100 g solution, a coating liquid prepared therefrom, e.g., for preparing a charge transport layer, cannot readily provide a charge transport layer having a required thickness because of too low a viscosity thereof.

The polycarbonate resin may exhibit a large effect, particularly when used as a binder resin for the charge generation layer or the charge transport layer.

Examples of the aromatic hydrocarbon solvent may include: benzene, toluene and xylene, and examples of the halogenated hydrocarbon solvent may include: monochlorobenzene and dichlorobenzene.

The electroconductive substrate constituting the electrophotographic photosensitive member may comprise a metal, such as aluminum or stainless steel; or paper or plastic provided with an electroconductive coating layer. The electroconductive substrate may be in the form of a cylinder or a sheet. Such an electroconductive substrate can be provided with an undercoating layer (adhesive layer) having a barrier function and a primer function.

More specifically, an undercoating layer may be provided for the purpose of providing, e.g., an improved adhesion of a photosensitive layer thereon, an improved coatability, a protection of the substrate, a coverage of local defects on the substrate, an improved charge injection from the substrate, and a protection of the photosensitive layer from electrical damage. The undercoating layer may comprise a material, such as polyvinyl alcohol, poly-N-vinylimidazole, polyethylene oxide, ethylcellulose, methylcellulose, ethylene-acrylic acid copolymer, casein, polyamide, copolymer nylon, glue, and gelatin. These materials may be dissolved in a solvent respectively suited therefor and applied onto the substrate in a thickness of preferably 0.2–2 μm.

In a function separation-type photosensitive member, a charge generation substance and a charge transport substance may be used. Examples of the charge generation substance may include: seleniumtellurium, pyrillium dyes, thiopyryllium dyes, phthalocyanine pigments, anthoanthrone pigments, benzpyrenequinone pigments, pyranthrone pigments, trisazo pigments, diazo pigments, azo pigments, indigo pigments, quinacridone pigments, asymmetric quinocyanines, quinocyanines, and amorphous silicon as disclosed in JP-A 54-143645. Examples of the charge transport substance may include pyrenes, N-ethylcarbazole, N-isopropylcarbazole, N-methyl-N-phenylhydrazino- 3-methylidene-9-ethylcarbazole, N,N-diphenylhydrazino- 3-methylidene-9-ethylcarbazole, N,N-diphenylhydrazino- 3-methylidene-10-ethylphenothiazine, N,N-diphenylhydrazino-3-methylidene-10-ethylphenoxazine; hydrazones, such as p-dichloroamino-benzaldehyde-N,N-diphenylhydrazone, p-diethylamino-benzaldehyde-N-aα-naphthyl-N-phenylhydrazoe, p-pyrrolidinobenzaldehyde-N,N-diphenylhydrazone, 1,3,3-trimethylindolenine-w-aldehyde-N,N-diphenylhydrazone, and p-diethylbenzaldehyde-3-methylbenzothiazolinone-2-hydrazone; 2,5-bis(p-diethylaminophenyl)-1,3,4-oxadiazole; pyrazolines, such as 1-phenyl-3-(p-diethylaminostyryl)- 5-(p-diethylaminophenyl)pyrazoline, 1-[quinolyl(2)]-3-(p-diethylaminostyryl)-pyrazoline, 5-(p-diethylaminophenyl)pyrazoline, 1-[pyridyl(2)]- 3-(p-diethylaminostyryl)-5-(p-dethylaminophenyl)-pyrazoline, 1-[6-methoxypyridyl(2)]-3-(p-diethylaminostyryl)- 5-(p-diethylaminophenyl)pyrazoline, 1-[pyridyl(3)]-3-(p-diethylaminostyryl)-5-(p-diethylaminophenyl)pyrazoline, 1-[pyridyl(2)]-3-(p-diethyl-aminostyryl)- 5-(p-diethylaminophenyl)pyrazoline, 1-[pyridyl(2)]-3-(@-diethylaminostyryl)-4-methyl-5-(p-diethylaminophenyl)pyrazoline, 1-[pyridyl(2)]-3-(α-methyl-p-diethylaminostyryl)- 5-(p-diethylaminophenyl)pyrazoline, 1-phenyl-3-(p-diethylaminostyryl)-4-methyl- 5-(p-diethylaminophenyl)-pyrazoline, 1-phenyl- 3-(α-benzyl-p-diethylaminostyryl)-5-(p-diethylaminophenyl)pyrazoline, and spiropyrazoline; oxazole compounds, such as 2-(p-diethylaminostyryl)-6-diethylaminobenzoxazole, 2-(p-diethylaminophenyl)-4-(p-dimethylaminophenyl)-5-( 2-chlorophenyl)oxazole; thiazole compounds, such as 2-(p-diethylaminostyryl)-6-diethylaminobenzothiazole; triarylmethane compounds, such as bis(4-diethylamino-2-methylphenyl)phenylmethane; and polyarylalkanes, such as 1,1-bis(4-N,N-diethylamino- 2-methylphenyl)heptane, and 1,1,2,2-tetrakis( 4-N,N-dimethylamino-2-methylphenyl)ethane.

The charge generation layer may for example be formed by dissolving or dispersing a charge-generating substance as described above together with 0.3–4 times thereof in amount of a binder resin in a solvent under sufficient action of a homogenizer, an ultrasonic disperser, a ball mill, a vibrating ball mill, a sand mill, an attritor or a roll mill, to form a coating liquid, followed by application and drying of the coating liquid. The charge generation layer may preferably be formed in a thickness of 0.1–1 μm.

In case where the above-mentioned polycarbonate resin is used in the charge generation layer, a coating liquid may be prepared by dissolving a charge generation substance and the polycarbonate resin may be both dissolved in a solvent comprising one or more of, e.g., aromatic hydrocarbon solvents and halogenated aromatic hydrocarbon solvents, or by dispersing a charge generation substance in a solution of the polycarbonate resin in such a solvent. The charge generation layer may be formed by applying and drying the coating liquid. The charge generation substance may be contained in a proportion of at least 30 wt. %, preferably at least 80 wt. %, in the charge generation layer. Particularly preferred examples of the solvent may include toluene, xylene and monochlorobenzene. The coating liquid may be applied, e.g., by dip coating, spray coating, spinner coating or curtain flow coating.

In case where the above-mentioned polycarbonate resin is used in the charge transport layer, a coating liquid may be prepared by dissolving a charge transport substance and the polycarbonate resin in a solvent as described above for the polycarbonate resin preferably selected from the aromatic hydrocarbon solvents and halogenated aromatic hydrocarbon solvents, and the resultant coating liquid may be applied to form a charge transport layer. The charge transport substance and the polycarbonate resin may preferably be mixed in a weight ratio in the range of 2:1–1:2. Particularly preferred examples of the solvent may include toluene, xylene and monochlorobenzene.

The coating liquid may be applied, e.g., by dip coating, spray coating, spinner coating, or curtain flow coating. For the production of electrophotographic photosensitive members accurately and in a large scale, the dip coating is most suited, and the pot life of the coating liquid in the dip coating can be remarkably improved by use of the above-mentioned polycarbonate resin so that the productivity according to the process including the dip coating can be remarkably improved. The coating layer thus formed may be dried under air blowing or in a still form at a temperature of 10°–200° C., preferably 20°–150° C., for a period of 5 min. to 5 hours, preferably 10 min. to 2 hours, thereby forming a charge transport layer in a thickness of, e.g., 5–20 μm.

Because of the use of a low-molecular weight toner binder resin comprising a resin component having a polar group, the toner is provided with an excellent fixability but, on the other hand, is liable to attach onto the photosensitive member, thus resulting in difficulties of a lower transferability, occurrence of cleaning failure and melt-sticking onto the photosensitive member.

For this reason, in the present invention, it is preferred in the present invention that the surface layer of the photosensitive member, e.g., the charge transport layer and/or the protective layer, contains a fluorine-containing compound and/or a silicon-containing compound.

More specifically, it is preferred that the outermost layer of the electrophotographic photosensitive member contains a fluorine-containing compound or/and a silicon-containing compound so as to provide a ratio of fluorine atom/carbon atom (F/C) or/and a ratio of silicon atom/carbon atom (Si/C); respectively based on number of atoms, of 0.03–1.00 as measured by X-ray photoelectron spectroscopy (XPS).

The inclusion of F atom or/and Si atom is effective in lowering the surface energy of the photosensitive member to provide an increased transferability of the toner and lowered attachment liability of the toner. On the other hand, the retention of a certain proportion of carbon atom may be set to avoid too low a surface energy of the photosensitive member. Thus, by retaining a specified ratio of F/C or/and Si/C, the photosensitive member is provided with a good transferability and is allowed to avoid cleaning failure even if used in combination with the above-mentioned toner showing a strong attachment or adhesion force.

If the ratio F/C or Si/C is below 0.03, the photosensitive member retains a high surface energy, thus resulting in an inferior transferability of the toner. On the other hand, if the ratio F/C or Si/C exceeds 1.00, the photosensitive member shows a lower friction coefficient with the cleaning member, thus being liable to cause a cleaning failure due to passing-by of the residual toner.

In a still further preferred embodiment of the present invention, the surface layer of the photosensitive member may preferably show a ratio of fluorine atom or/and silicon atom to oxygen atom (F/O or/and Si/O), respectively, of at least 0.03 as measured by XPS. By specifying the amount of oxygen with respect to F or/and Si in the above-described manner, it becomes possible to preferably control the attachment force of the toner comprising a resin component having a polar group onto the photosensitive member.

The photosensitive member surface may be imparted with fluorine atom by inclusion of a fluorine-containing compound, particularly a fluorine-containing organic compound, examples of which may include: polymers or copolymers of tetrafluoroethylene, trifluorochloroethylene, hexafluoropropylene, vinyl fluoride, vinylidene fluoride and difluorodichloroethylene. It is also possible to use a fluorinated carbon. These fluorine-containing compounds or substances may be used singly or in combination of two or more species.

In the present invention, it is also possible to use one or more species of block polymers or graft polymers containing a fluorine-containing segment synthesized from a fluorine containing monomer alone or in combination with another polymerizable monomer; fluorine-containing surfactants; or fluorine-containing macromolecules, singly or in mixture with a fluorine-containing resin as described above.

It is particularly preferred to use a fluorine-containing graft-polymer including fluorine-containing segments continuously present therein in order to provide a good dispersion of the fluorine containing resin and facilitate the control of the F/C ratio in the surface layer.

Preferred examples of the fluorine-containing monomer are enumerated hereinbelow but they are not exhaustive.

$$CH_2{=}CHF \quad (1)$$
$$CH_2{=}CF_2 \quad (2)$$
$$CHF{=}CF_2 \quad (3)$$
$$CF_2{=}CF_2 \quad (4)$$
$$CF_2{=}CFCl \quad (5)$$
$$CF_2{=}CFCF_3 \quad (6)$$
$$CF_2{=}CF{-}Rf \quad (7)$$
$$CF_2{=}CF{-}O{-}Rf \quad (8)$$
$$CH_2{=}CH{-}Rf \quad (9)$$
$$CH_2{=}CH{-}O{-}Rf \quad (10)$$

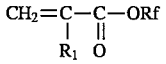
(11)

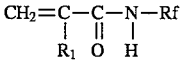
(12)

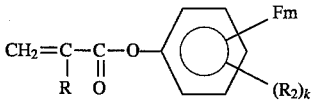
(13)

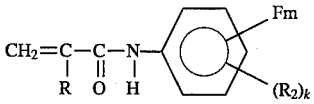
(14)

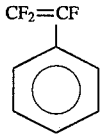
(15)

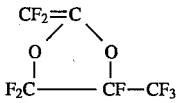
(16)

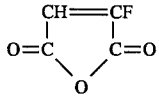
(17)

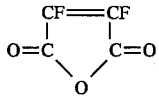
(18)

In the above formulae, $R_1$ denotes a hydrogen atom, halogen atom or methyl group; $R_2$ denotes a hydrogen atom, halogen atom, alkyl group, alkoxy group or nitride group with the proviso that a plurality of $R_2$ can be the same or different; k denotes an integer of 1–4, m denotes an integer of 1–5 satisfying k+m=5; and Rf denotes an alkyl group having at least one substituent of fluorine atom.

The non-fluorine containing monomer may include, for example: low-molecular weight linear unsaturated hydrocarbons, vinyl chloride, organic acid vinyl esters, vinyl-aromatic compounds, esters of acrylic acids and methacrylic acids, N-vinyl compounds, vinyl-silicon compounds, maleic anhydride, and esters of maleic acid and fumaric acid. They may be used singly or in mixture of two or more species. It is preferred that the fluorine-containing polymer or copolymer is mutually soluble with a principal resin constituting the charge transport layer and/or the protective layer, or has an affinity with the principal resin because of a structural similarity even if not satisfying a complete mutual solubility.

The silicon-containing compound for imparting silicon atom to the photosensitive member surface may be silicone compounds, which may include: monomethylsiloxane three-dimensionally crosslinked product, dimethylsiloxane-monomethylsiloxane three-dimensionally crosslinked product, polydimethylsiloxane compounds including those having an ultrahigh molecular weight, block copolymer and graft polymer containing a polydimethylsiloxane segment, silicone surfactant, silicone macromonomer, and terminal-modified polydimethylsiloxane compound. In the case of the three-dimensionally crosslinked product used in the form of fine particles, the average particle size may preferably be in the range of 0.01–5 μm. The polydimethylsiloxane may preferably have a molecular weight of 3,000–$5\times10^6$. The silicon-containing compound, if it is in the form of fine particles, may be dispersed together with a binder resin to form a photosensitive layer composition. The dispersion may be performed by a sand mill, a ball mill, a roll mill, a homogenizer, a nanomizer, a paint shaker and an ultrasonic disperser. At the time of dispersion, it is preferred to co-use the above-mentioned graft-polymer or block polymer or surfactant. This is also preferred so as to control the Si/C ratio.

The sole figure illustrates an outline of an image forming apparatus suitable for practicing the image forming method according to the present invention.

Referring to the figure, a photosensitive drum (i.e., electrophotographic photosensitive member) 101 as an image-carrying member is rotated about an axis 101*a* at a prescribed peripheral speed in the direction of the arrow shown inside of the photosensitive drum 101. The surface of the photosensitive drum is uniformly charged by means of a charger 102 to have a prescribed positive or negative potential. The photosensitive drum 101 is exposed to light-image L (as by slit exposure or laser beam-scanning exposure) by using an image exposure means (not shown), whereby an electrostatic image corresponding to an exposure image is successively formed on the surface of the photosensitive drum 101. The electrostatic image is developed by a developing means 104 to form a toner image on the photosensitive member surface. The toner image is successively transferred to a transfer material P which is supplied from a supply part (not shown) to a position between the photosensitive drum 101 and a transfer charger 105 in synchronism with the rotating speed of the photosensitive drum 101, by means of the transfer charger 105. Alternatively, it is also possible that the toner image on the photosensitive member is once transferred to an intermediate transfer member and then transferred from the intermediate transfer member to the transfer material P.

The transfer material P with the toner image thereon is separated from the photosensitive drum 101 to be conveyed to a fixing device 108, followed by image fixing to print out the transfer material P as a copy out of the electrophotographic apparatus. Residual toner particles on the surface of the photosensitive drum 101 after the transfer are removed by means of a cleaner 106 to provide a cleaned surface, and residual charge on the surface of the photosensitive drum 101 is erased by a pre-exposure means 107 to prepare for the next cycle. As the charger 102 for charging the photosensitive drum 101 uniformly, a corona charger or a contact charging means such a charging roller may be used. As the transfer charger 105, such a corona charger or a contact charging means such as a charging roller may also be used.

In the present invention, a plurality among the above-mentioned structural elements inclusive of the photosensitive member, charging means and the developing means can be integrally supported to form an apparatus unit, which is detachably mountable to a main body of the image forming apparatus by using a guide means such as a rail in the body.

In case where the electrophotographic apparatus is used as a copying machine or a printer, the exposure to image light L may be performed by illuminating the photosensitive member with reflected light from or transmitted light through an original, or with a scanning laser beam or an image light from an LED array or a liquid crystal shutter array driven based on signals produced from data read from an original.

Hereinbelow, the present invention will be described based on Examples which however should not be construed to restrict the present invention in any way. First of all, production examples of toners and drums and evaluation methods are described.

[Production Example 1 for polymerization toner]

Into 710 g of deionized water, 450 g of 0.1M–$Na_3PO_4$ aqueous solution was added, and the mixture was warmed at 60° C. and stirred at 12,000 rpm by a TK homomixer (mfd. by Tokushu Kika Kogyo K.K.). Further, 68 g of 1.0M–$CaCl_2$ aqueous solution was added thereto to form an aqueous medium containing $Ca_3(PO_4)_2$.

| | |
|---|---|
| Styrene | 165 g |
| n-Butyl acrylate | 35 g |
| Phthalocyanine pigment | 10 g |
| Di-t-butylsalicylic acid metal compound | 1 g |
| Styrene-methacrylic acid copolymer (95:5 by mol, Mw (weight-average molecular weight = $5\times10^4$)) | 10 g |
| Paraffin wax (m.p. (melting point) = 83° C.) | 8 g |

The above ingredients were warmed at 60° C. and stirred at 12000 rpm by a TK homomixer (mfd. by Tokushu Kika Kogyo K.K.) to effect uniform dissolution and dispersion. Into the mixture, 8 g of 2,2'-azobis( 2,4-dimethylvaleronitrile) (polymerization initiator) was dissolved to form a polymerizable monomer composition, which was then added to the above-prepared aqueous medium. The resultant mixture was then stirred at 10000 rpm for 20 min. by a TK homomixer at 60° C. in a nitrogen gas atmosphere to disperse the polymerizable monomer composition into particles. Then, the system was heated to 70° C. under stirring by a paddle stirrer for 10 hours of reaction.

After the polymerization reaction, a part of the aqueous medium was distilled off under vacuum, and the system was cooled, followed by addition of hydrochloric acid to dissolve the calcium phosphate, filtration, washing with water and drying to recover toner particles having a weight-average particle size of ca. 8 μm.

To 100 wt. parts of the thus obtained toner particles, 0.8wt. part of hydrophobic silica was added to obtain polymerization toner A.

[Production Example 2 for polymerization toner]

Polymerization toner B was prepared in the same manner as in Production Example 1 except that the phthalocyanine pigment as the colorant was changed to carbon black and the amount of the polymerization initiator was changed to 10 g.

[Production Example 3 for polymerization toner]

Polymerization toner C (comparative) was prepared in the same manner as in Production Example 1 except that the styrene-methacrylic acid copolymer as a resin component having a polar group was omitted.

[Production Examples 4 an 5 for polymerization toner]

Polymerization toner D (comparative) and polymerization toner E (comparative) having main peaks at different molecular weights in molecular weight distribution were prepared by changing the species and amount of the polymerization initiator and the polymerization temperature.

[Production Example 1 for pulverization toner]

| | |
|---|---|
| Styrene-n-butyl acrylate copolymer (Mp = 20,000) | 100 wt. parts |
| Styrene-methyl methacrylate-methacrylic acid copolymer (Mp = 20,000) | 100 wt. parts |
| Di-tert-butylsalicylic acid metal compound | 4 wt. parts |
| Paraffin wax (m.p. = 83° C.) | 8 wt. parts |

-continued

| | |
|---|---|
| Phthalocyanine pigment | 5 wt. parts |

The above ingredients were preliminarily blended and then melt-kneaded on a roll mill set at 120° C.

After cooling, the kneaded product was coarsely crushed, finely pulverized by a pulverizer using jet air stream and then classified by a pneumatic classifier to obtain a toner having a weight-average particle size of ca. 8 μm. To 100 wt. parts of the toner, 0.8 wt. part of hydrophobic silica having a BET specific surface area of 200 $m^2/g$ was externally added to obtain pulverization toner 1.

Some properties of the above-prepared toners A–E and toner 1 are summarized in Table 1 appearing hereinafter.

[Production Examples 1–4 for photosensitive drum]

10 wt. parts of electroconductive titanium oxide (coated with tin oxide, average primary particle size=0.4 μm), 10 wt. parts of phenolic resin precursor (resol-type), 10 wt. parts of methanol and 10 wt. parts of butanol were subjected to dispersion in a sand mill, and then the mixture was applied onto an aluminum cylinder in an outer diameter of 80 mm and a length of 360 mm by dipping, followed by curing at 140° C. to form a 20 μm-thick electroconductive layer having a volume resistivity of $5\times10^9$ ohm.cm.

Then, 10 wt. parts of a methoxymethylated nylon (methoxymethylation degree=ca. 30%) shown below and 150 wt. parts of isopropanol were mixed and dissolved to each other to form a mixture solution, which as then applied by dipping onto the aboveprepared electroconductive layer to form a 1 μm-thick undercoating layer:

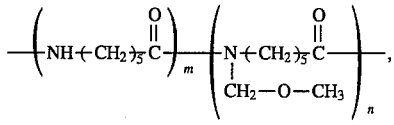

wherein m and n are integers giving the indicated methoxymethylation degree.

Then, 10 wt. parts of the following azo pigment:

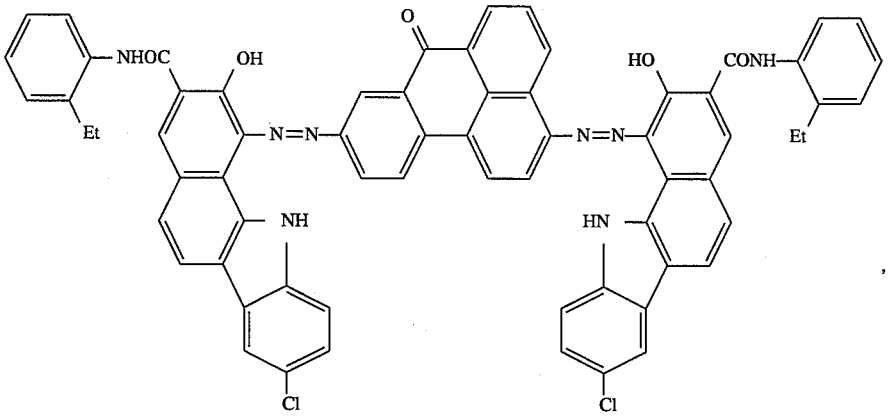

5 wt. parts of the following polycarbonate resin (bisphenol A-based, molecular weight=$3\times10^4$)

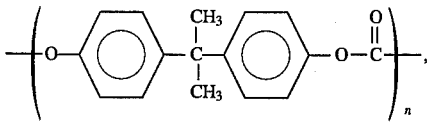

wherein n is an integer providing the indicated molecular weight, and 700 wt. parts of cyclohexanone were dispersed in a sand mill to form a dispersion liquid, which was then applied by dipping onto the above-formed undercoating layer to form a 0.05 μm-thick charge generation layer.

Then, 10 wt. parts of the following triphenylamine compound

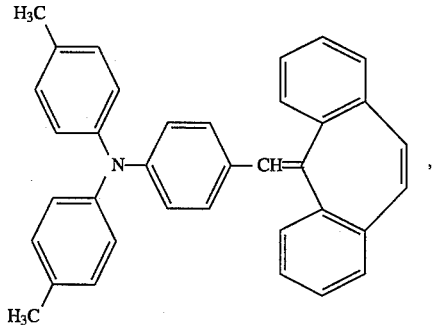

10 wt. parts of the following polycarbonate resin (bisphenol Z-based, molecular weight=$2\times10^4$),

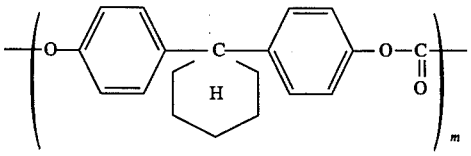

wherein m denotes an integer providing the indicated molecular weight, 50 wt. parts of monochlorobenzene and 15 wt. parts of dichloroethane were mixed under stirring to form a mixture liquid, which was then applied by dipping onto the above-formed charge in generation layer and dried under blowing with hot air to form a 20 μm-thick charge transport layer.

Then, 1 wt. part of fluorinated carbon fine powder (Dav (average particle size))=0.23 μm, mfd. by Central Glass K.K.), 6 wt. parts of the following polycarbonate resin (bisphenol Z-based, molecular weight=$8\times10^4$):

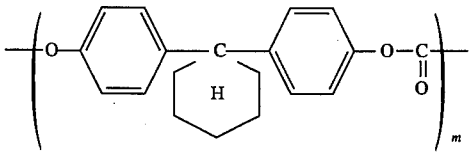

wherein m denotes an integer, 0.1 wt. part of the following perfluoroalkyl acrylate-methyl methacrylate block copolymer (molecular weight=$3\times10^4$)

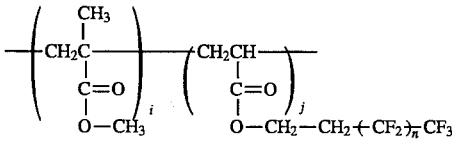

wherein i and j respectively denote an integer and n denotes an integer of 4–16, 120 wt. parts of monochlorobenzene and 80 wt. parts of dichloromethane were subjected to mixing and dispersion in a sand mill to form a mixture liquid. To the mixture liquid, 3 wt. parts of the following triphenylamine

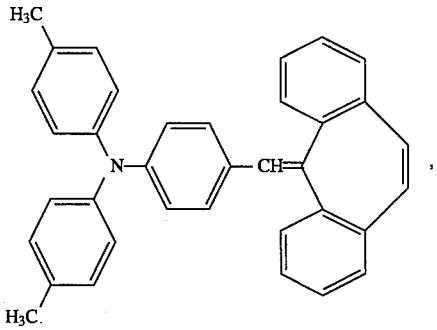

and a prescribed amount of $FeCl_3$ were further added and dissolved therein. The resultant mixture liquid was applied by spray coating onto the above-formed charge transport layer to form a 5 μm-thick protective layer.

The above procedure was repeated four times while changing the prescribed amounts of the $FeCl_3$, thereby to obtain four photosensitive drums A–D having different Fe contents in the surface layers, i.e., A (0.2 ppm), B (2.0 ppm), C (0.05 ppm) and D (15 ppm).

[Production Example 5 for photosensitive drum]

Photosensitive drum E was prepared in the same manner as in Production Example 1 except that the Protective layer was prepared in the following manner.

1 wt. part of true-spherical three-dimensionally crosslinked polysiloxane particles (Dav= 0.29 μm, mfd. by Toshiba Silicone K.K.), 6 wt. parts of the following polycarbonate resin (bisphenol Z-based, molecular weight=$8\times10^4$):

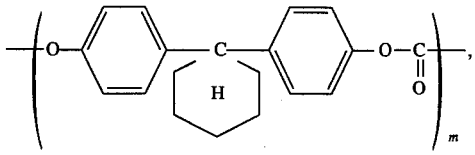

wherein m denotes an integer, 0.1 wt. part of the following polydimethylsiloxane methacrylate-methyl methacrylate block copolymer (molecular weight=$5\times10^4$ Si content=12 wt. %):

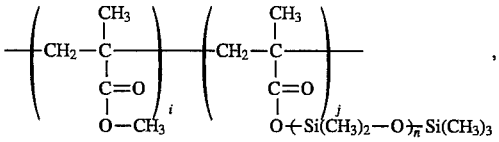

wherein m and j respectively denote an integer and n denotes an integer of 1–100, 120 wt. parts of monochlorobenzene and 80 wt. parts of dichloromethane were mixed and dispersed to form a mixture. To the mixture, 3 wt. parts of the following triphenylamine:

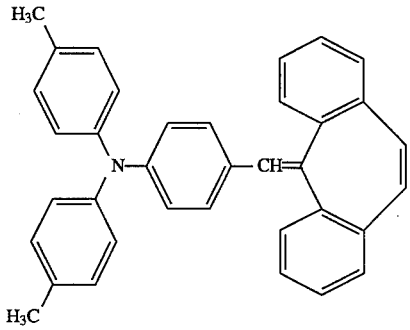

and $FeCl_3$ in an amount providing a surface layer Fe content of 1.0 ppm were added and dissolved therein to form a mixture liquid, which was then applied by spray coating onto the formerly prepared charge transport layer to form a 3 μm-thick protective layer, thereby providing photosensitive drum E.

<Measurement of transition metal content>

The charge transport layer and the protective layer of a sample photosensitive drum was peeled off and weighed. The peeled layers were burnt in a muffle furnace, and the residue was wet-treated with a mixture acid of sulfuric acid and nitric acid to form a measurement sample. The sample was subjected to identification and quantitative analysis of a transition metal content by atomic absorption spectrometry. Based on the measurement result, the content of the transition metal contained in the surface layer (i.e., the charge transport layer and the protective layer in lamination i this case).

The transition metal contents in the surface layers of photosensitive drums A–E thus measured are summarized in Table 1.

<XPS measurement of the outermost layer surface of a photosensitive member>

XPS measurement of the outermost layer surface of a sample photosensitive drum was performed with respect to a cut-out and flattened sample of the surface layer from the sample drum by using an X-ray photoelectron spectroscopy ("ESCALAB, model 200-X", available from VG Co.). The measurement was performed by using Mg-Kα ray (300 W) as the X-ray source for an analyzing area of 2 mm×3 mm. This generally corresponds to the analysis of a depth of up to several angstroms from the surface.

EXAMPLE 1

A commercially available full-color laser electrophotographic copying machine ("CLC-500", mfd. by Canon K.K.) was remodeled by replacing the photosensitive drum with the photosensitive drum A prepared in Production Example 1. The remodeled machine, after being loaded with a two-component type developer comprising the above-prepared toner A and a magnetic ferrite carrier coated with styrene-acrylate copolymer, was subjected to image formation, wherein the photosensitive drum A was irradiated with laser light to form a digital electrostatic image thereon, and the electrostatic image was developed with the two-component type developer according to the reversal development scheme under application of an alternating bias onto the developing sleeve to form a toner image. The toner image on the photosensitive drum A was further transferred onto a regenerated paper of 64 g/m$^2$ (classified under plain paper, A4-size) to form a yet-unfixed toner image. The drum surface after the transfer was subjected to blade cleaning by using a urethane rubber blade.

The thus formed unfixed toner images on the regenerated paper were subjected to a fixability test by passing through between a pair of fixing rollers including a teflon-coated upper roller and a silicone rubber-coated lower roller in a temperature-adjustable external fixing device under the conditions of a nip of 4.5 mm, a linear pressure of 0.6 kg/cm, a process speed of 90 mm/sec and varying temperatures at an increment of 5° C. in the range of 100°–230° C.

The fixability was tested by rubbing a fixed image with a lens cleaning paper ("DASPER", mfd. by Ozu Paper Co. Ltd.) under a load of 50 g/cm$^2$ and evaluated in terms of a fixing initiation temperature which was the lowest temperature providing a density lowering by the rubbing of below 10%. During the fixing test, the occurrence of offset was observed with eyes and evaluated in terms of a high temperature offset-free point which was the highest temperature at which offset was not observed with eyes.

Separately, by using the remodeled machine, a continuous image formation test of reproducing a test image including a solid part and a halftone part on 10,000 sheets. Then, the images were evaluated with respect to roughening at halftone parts, thin-line reproducibility, and uniformity of solid image density. The performances were evaluated in an overall manner by taking these items into in consideration inclusively. The results were evaluated at four ranks of excellent, good, fair and poor as shown in Table 1.

EXAMPLE 2–4 AND COMPARATIVE EXAMPLES 1–5

The image forming test and fixing test were repeatedly performed in a similar manner as in Example 1 by using toners and photosensitive drums shown in Table 1. The results are inclusively shown in Table 1.

TABLE 1*

| | Toner | | | Photosensitive drum | | | | Evaluation | | | |
|---|---|---|---|---|---|---|---|---|---|---|---|
| | | Resin | | | | | | | | | |
| | | Polar *1 resin comp. | Mp *2 on GPC | | $M_{trans}$ *3 content | Outermost later | | Crack on drum *4 | Fixability $T_{FI}$ *5 (°C.) | Fixability $T_{offset}$ *6 (°C.) | Image *7 forming performance |
| Example | Name** | | | Name | (ppm) | Si/C | F/C | | | | |
| Ex. 1 | A | yes | 20,000 | A | 0.2 | 0.0 | 0.064 | none | 140 | 175 | excellent |
| 2 | B | yes | 19,900 | E | 1.0 | 0.147 | 0.0 | none | 140 | 175 | good |
| 3 | 1 | yes | 20,000 | A | 0.2 | 0.0 | 0.064 | none | 140 | 175 | excellent |
| 4 | A | none | 20,000 | B | 2.0 | 0.0 | 0.064 | none | 140 | 175 | good |
| Comp. Ex. 1 | C | none | 20,100 | C | 0.05 | 0.0 | 0.064 | yes | 150 | 175 | poor |
| 2 | D | yes | 4,500 | A | 0.2 | 0.0 | 0.064 | — | 130 | 150 | poor *71 |
| 3 | E | yes | 57,000 | A | 0.2 | 0.0 | 0.064 | none | 175 | 180 | fair *72 |
| 4 | A | yes | 20,000 | C | 0.05 | 0.0 | 0.064 | yes | 140 | 175 | poor |
| 5 | A | yes | 20,000 | D | 15 | 0.0 | 0.064 | none | 140 | 175 | poor *73 |

*Notes to the above table appear on the following page.

Notes to Table 1

(Toner)

**: Toner 1 used in Example 3 alone was a pulverization toner and the other toners A–E were polymerization toners.

*1: Presence (yes) or absence (none) of a polar resin component in the toner.

*2: Molecular weight at which the main peak in a GPC chromatogram was present.

(Photosensitive drum)

*3: The transition metal content in the surface layer of the photosensitive drum.

(Evaluation)

*4: Occurrence (yes) or non-occurrence (none) of cracks on the photosensitive drum during the continuous image forming test.

*5: $T_{FI}$: The fixing initiation temperature.

*6: Toffset: The highest offset-free temperature.

*7: Overall evaluation with respect to the roughening at halftone parts, thin-line reproducibility and uniformity of solid part density.

*71: Blocking occurred.

TABLE 1*-continued

| | Toner | | | | | | | | | | |
|---|---|---|---|---|---|---|---|---|---|---|---|
| | | Resin | | Photosensitive drum | | | | Evaluation | | | |
| | | Polar *1 resin comp. | Mp *2 on GPC | Name | $M_{trans}$ *3 content (ppm) | Outermost later Si/C | Outermost later F/C | Crack on drum *4 | Fixability $T_{FI}$ *5 (°C.) | Fixability $T_{offset}$ *6 (°C.) | Image *7 forming performance |
| Example | Name** | | | | | | | | | | |

*72: Narrow fixable temperature range.
*73: Poor resolution.

[Production Example 6 for polymerization toner]

Into 710 g of deionized water, 450 g of 0.1M–$Na_3PO_4$ aqueous solution was added, and the mixture was warmed at 60° C. and stirred at 1200 rpm by a TK homomixer (mfd. by Tokushu Kika Kogyo K.K.). Further, 68 g of 1.0M–$CaCl_2$ aqueous solution was added thereto to form an aqueous medium containing $Ca_3(PO_4)_2$.

| | |
|---|---|
| Styrene | 165 g |
| n-Butyl acrylate | 35 g |
| Hydrophobicity-imparted magnetic material | 140 g |
| Nigrosine dye | 2 g |
| Styrene-dimethylaminoethyl methacrylate copolymer | 10 g |
| Paraffin wax (m.p. (melting point) = 83° C.) | 8 g |

The above ingredients were warmed at 60° C. and stirred at 12000 rpm by a TK homomixer (mfd. by Tokushu Kika Kogyo K.K.) to effect uniform dissolution and dispersion. Into the mixture, 8 g of 2,2'-azobis( 2,4-dimethylvaleronitrile) (polymerization initiator) was dissolved to form a polymerizable monomer composition, which was then added to the above-prepared aqueous medium. The resultant mixture was then stirred at 10000 rpm for 20 min. by a TK homomixer at 60° C. in a nitrogen gas atmosphere to disperse the polymerizable monomer composition into particles. Then, the system was heated to 70° C. under stirring by a paddle stirrer for 10 hours of reaction.

After the polymerization reaction, a part of the aqueous medium was distilled off under vacuum, and the system was cooled, followed by addition of hydrochloric acid to dissolve the calcium phosphate, filtration, washing with water and drying to recover toner particles having a weight-average particle size of ca. 8 μm.

To 100 wt. parts of the thus obtained toner particles, 0.8 wt. part of hydrophobic silica was added to obtain polymerization toner F.

[Production Example 7 for polymerization toner]

Polymerization toner G was prepared in the same manner as in Production Example 6 except that the polar resin component was changed as shown in Table 4 appearing hereinafter.

[Production Example 2 for pulverization toner]

| | |
|---|---|
| Styrene-n-butyl acrylate copolymer (Mp = 20,000) | 100 wt. parts |
| Styrene-methyl methacrylate-methacrylic acid copolymer (Mp = 20,000) | 100 wt. parts |
| Di-tert-butylsalicylic acid metal compound | 4 wt. parts |
| Paraffin wax (m.p. = 83° C.) | 8 wt. parts |
| Carbon black (hydrophobicity-imparted) | 12 wt. parts |

The above ingredients were preliminarily blended and then melt-kneaded on a roll mill set at 120 ° C.

After cooling, the kneaded product was coarsely crushed, finely pulverized by a pulverizer using jet air stream and then classified by a pneumatic classifier to obtain a toner having a weight-average particle size of ca. 8 μm. To 100 wt. parts of the toner, 0.8 wt. part of hydrophobic silica having a BET specific surface area of 200 $m^2/g$ was externally added to obtain pulverization toner 1.

Some properties of the above-prepared toners F, G and toner 2 are shown in Table 4 appearing hereinafter.

[Production Example 6 for photosensitive drum]

10 wt. parts of electroconductive titanium oxide particles (coated with tin oxide, average primary particle size=0.4 μm), 10 wt. parts of phenolic resin precursor (resol-type), 10 wt. parts of methanol and 10 wt. parts of butanol were subjected to dispersion in a sand mill, and then the mixture was applied onto an aluminum cylinder in an outer diameter of 80 mm and a length of 360 mm by dipping, followed by curing at 140° C. to form a 20 μm-thick electroconductive layer having a volume resistivity of $5\times10^9$ ohm.cm.

Then, 10 wt. parts of a methoxymethylated nylon (methoxymethylation degree=ca. 30%) shown below and 150 wt. parts of isopropanol were mixed and dissolved to each other to form a mixture solution, which as then applied by dipping onto the above-prepared electroconductive layer to form a 1 μm-thick undercoating layer:

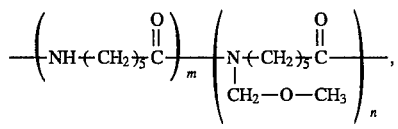

wherein m and n are integers giving the indicated methoxymethylation degree.

Then, 10 wt. parts of the following azo pigment:

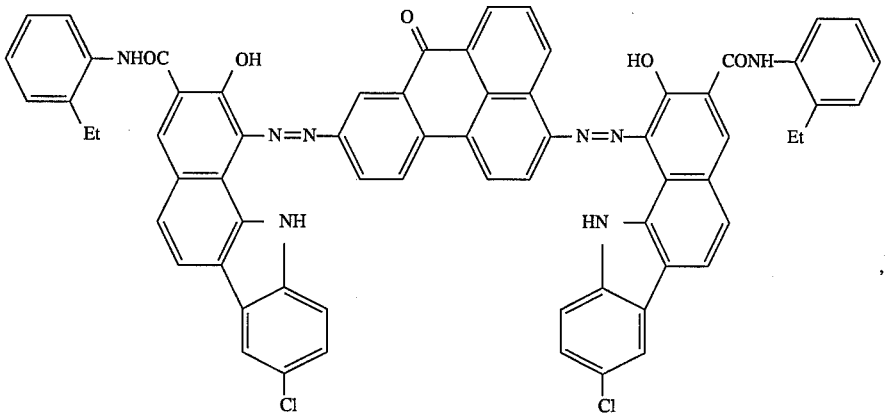

5 wt. parts of the following polycarbonate resin (bisphenol A-based, molecular weight=$3\times10^4$)

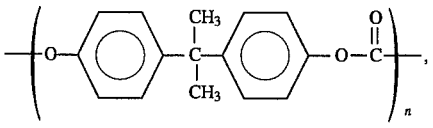

wherein n is an integer providing the indicated molecular weight, and 700 wt. parts of cyclohexanone were dispersed in a sand mill to form a dispersion liquid, which was then applied by dipping onto the above-formed undercoating layer to form a 0.05 μm-thick charge generation layer.

Then, 10 wt. parts of the following triphenylamine compound

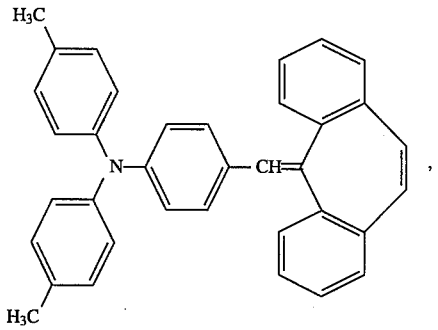

10 wt. parts of the following polycarbonate resin (bisphenol Z-based, molecular weight=$2\times10^4$),

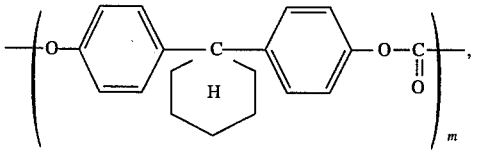

wherein m denotes an integer providing the indicated molecular weight, 50 wt. parts of monochlorobenzene and 15 wt. parts of dichloroethane were mixed under stirring to form a mixture liquid, which was then applied by dipping onto the above-formed charge generation layer and dried under blowing with hot air to form a 20 μm-thick charge transport layer.

Then, 1 wt. part of fluorinated carbon fine powder (Dav (average particle size))=0.23 μm, mfd. by Central Glass K.K.), 6 wt. parts of the following polycarbonate resin (bisphenol Z-based, molecular weight=$8\times10^4$):

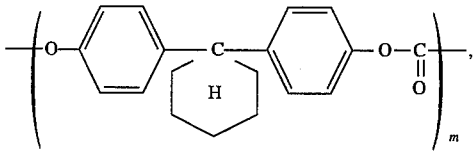

wherein m denotes an integer, 0.1 wt. part of the following perfluoroalkyl acrylate-methyl methacrylate block copolymer (molecular weight=$3\times10^4$)

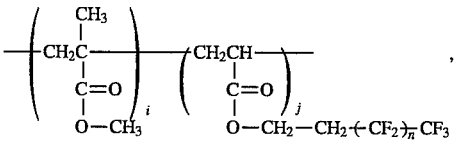

wherein i and j respectively denote an integer and n denotes an integer of 4–16, 120 wt. parts of monochlorobenzene and 80 wt. parts of dichloromethane were subjected to mixing and dispersion in a sand mill to form a mixture liquid. To the mixture liquid, 3 wt. parts of the following triphenylamine

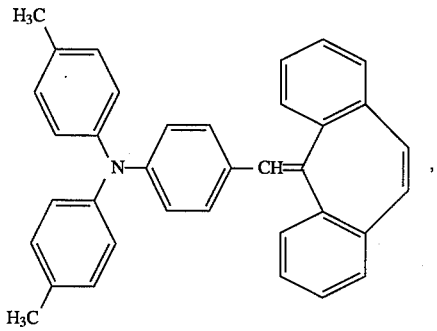

and a prescribed amount of $FeCl_3$ were further added and dissolved therein. The resultant mixture liquid was applied by spray coating onto the above-formed charge transport layer to form a 5 μm-thick protective layer, thereby providing a photosensitive drum F showing a surface layer Fe content of 0.2 ppm.

As a result of the XPS measurement, the outermost layer of the photosensitive drum F showed F atom content of 5.2 % (by number of atoms), C atom content of 81.3% (by number of atoms), and F/C ratio of 0.064 (based on number of atoms).

[Production Example 7 for photosensitive drum]

The procedure of Production Example 6 was repeated up to the provision of the aluminum cylinder, electroconductive layer, under coating layer and charge generation layer.

Then, 10 wt. parts of the following triphenylamine compound

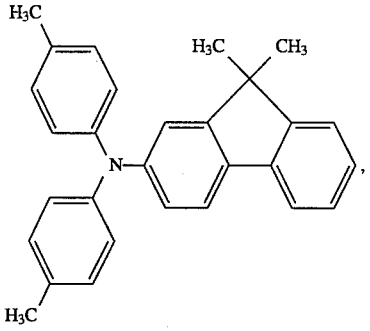

10 wt. parts of the following polycarbonate resin (bisphenol Z-based, molecular weight=$2\times10^4$),

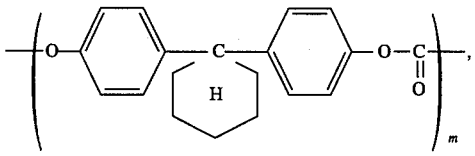

wherein m denotes an integer providing the indicated molecular weight, 50 wt. parts of monochlorobenzene and 15 wt. parts of dichloromethane were mixed under stirring to form a mixture liquid, which was then applied by dipping onto the above-formed charge generation layer and dried under blowing with hot air to form a 20 μm-thick charge transport layer.

Then, 3 wt. part of fluorinated carbon fine powder (Dav.)= 0.23 μm, mfd. by Central Glass K.K. ), 5 wt. parts of the following polycarbonate resin (bisphenol Z-based, molecular weight=$8\times10^4$):

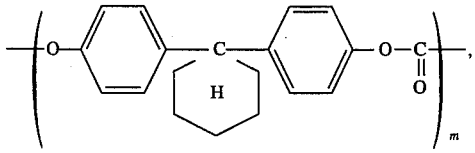

wherein m denotes an integer, 0.3 wt. part of the following perfluoroalkyl acrylate-methyl methacrylate block copolymer (A–B type copolymer, molecular weight=$3\times10^4$)

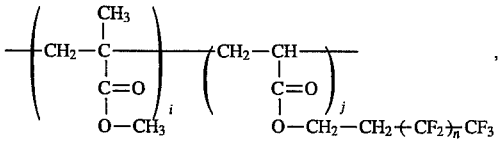

wherein i and j respectively denote an integer and n denotes an integer of 4–16, 110 wt. parts of monochlorobenzene and 80 wt. parts of dichloromethane were subjected to mixing and dispersion in a sand mill to form a mixture liquid. To the mixture liquid, 2.5 wt. parts of the following triphenylamine

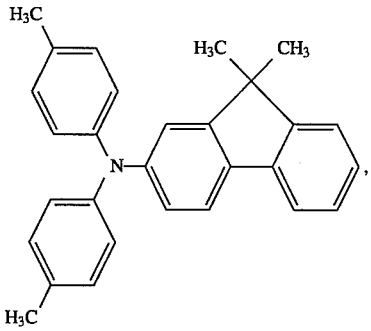

and a prescribed amount of $FeCl_3$ were further added and dissolved therein. The resultant mixture liquid was applied by spray coating onto the above-formed charge transport layer to form a 6 μm-thick protective layer, thereby providing a photosensitive drum G showing a surface layer Fe content of 0.2 ppm.

The photosensitive drum G showed F atom content of 10.2%, C atom content of 76.7%, and F/C ratio of 0.133.

[Production Example 8 for photosensitive drum]

The procedure of Production Example 6 was repeated up to the provision of the aluminum cylinder, electroconductive layer, under coating layer and charge generation layer.

Then, 3 wt. parts of the following triphenylamine compound

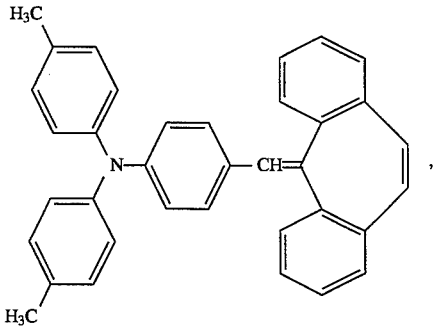

7 wt. parts of the following triphenylamine

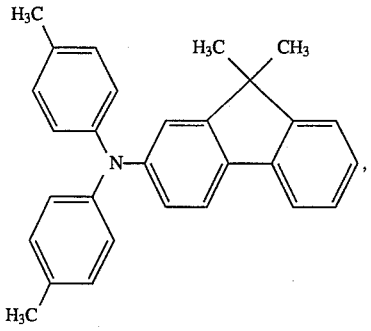

10 wt. parts of the following polycarbonate resin (bisphenol Z-based, molecular weight=$2\times10^4$),

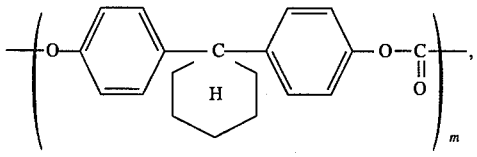

wherein m denotes an integer providing the indicated molecular weight, 50 wt. parts of monochlorobenzene and 15 wt. parts of dichloromethane were mixed under stirring to form a mixture liquid, which was then applied by dipping onto the above-formed charge generation layer and dried under blowing with hot air to form a 20 μm-thick charge transport layer. Then, 3 wt. parts of fluorinated carbon fine powder (Dav.)=0.27 μm, mfd. by Central Glass K.K.), 5.5 wt. parts of the following polycarbonate resin (bisphenol Z-based, molecular weight=$8\times10^4$):

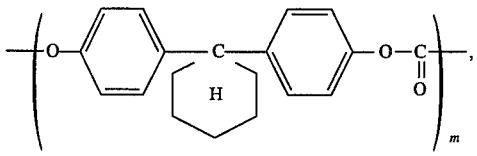

wherein m denotes an integer, 0.3 wt. part of the following fluorine-substituted graft polymer (F content=27 wt. %, molecular weight=$2.5\times10^4$):

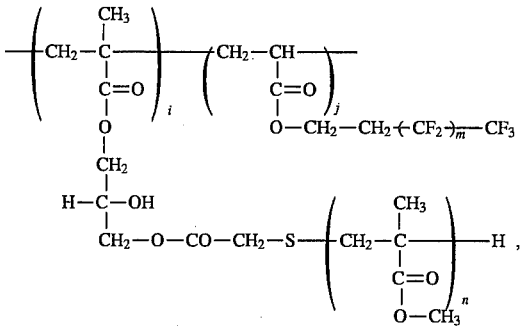

wherein i, j, m and n respectively denote an integer, 120 wt. parts of monochlorobenzene and 80 wt. parts of dichloromethane were subjected to mixing and dispersion in a sand mill. Further, 2.5 wt. parts of the following triphenylamine was added thereto and dissolved therein to form a mixture liquid:

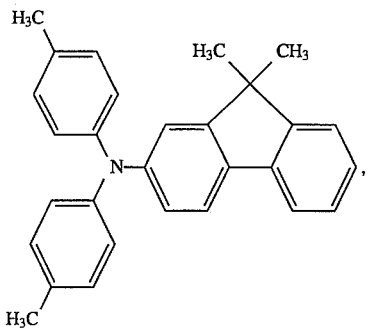

To the mixture liquid, 2 wt. parts of the following triphenylamine

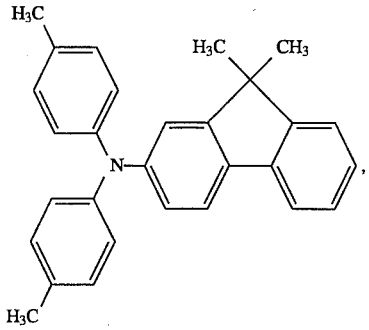

and a prescribed amount of $FeCl_3$ were further added and dissolved therein. The resultant mixture liquid was applied by spray coating onto the above-formed charge transport layer to form a 4 μm-thick protective layer, thereby providing a photosensitive drum F showing a surface layer Fe content of 0.2 ppm.

The photosensitive drum H showed F atom content of 11.3%, C atom content of 75.5%, and F/C ratio of 0.150.

[Production Example 9 for photosensitive drum]

Photosensitive drum I was prepared in the same manner as in Production Example 6 except that the Protective layer was prepared in the following manner.

1 wt. part of true-spherical three-dimensionally crosslinked polysiloxane particles (Dav= 0.29 μm, mfd. by Toshiba Silicone K.K.), 6 wt. parts of the following polycarbonate resin (bisphenol Z-based, molecular weight=$8\times10^4$):

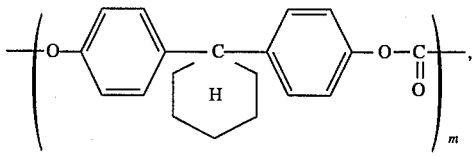

wherein m denotes an integer, 0.1 wt. part of the following polydimethylsiloxane methacrylate-methyl methacrylate block copolymer (molecular weight=$5\times10^4$ Si content=12 wt %):

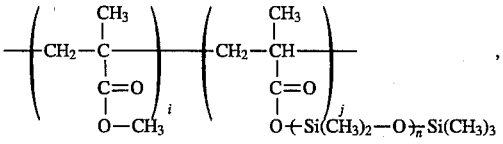

wherein i and j respectively denote an integer and n denotes an integer of 1 - 100, 120wt. parts of monochlorobenzene and 80 wt. parts of dichloromethane were mixed and dispersed to form a mixture. To the mixture, 3 wt. parts of the following triphenylamine:

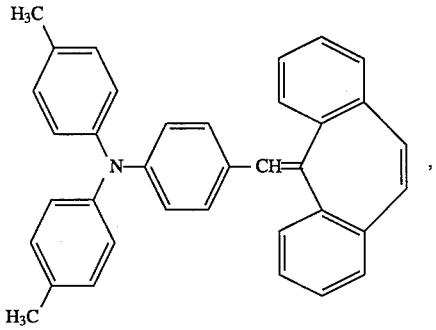

and a prescribed amount of $FeCl_3$ were added dissolved therein to form a mixture liquid, which was then applied by spray coating onto the formerly prepared charge transport layer to form a 3 μm-thick protective layer, thereby providing photosensitive drum I showing a surface layer Fe content of 0.2 ppm.

As a result of the XPS measurement, the photosensitive drum I showed Si atom content of 10.2%, C atom content of 69.3% and Si/C ratio of 0.147.

[Production Example 10 for photosensitive drum]

The procedure of Production Example 9 was repeated up to the provision of the aluminum cylinder, electroconductive layer, under coating layer and charge generation layer (i.e., equal to that of Production Example 6).

Then, 10 wt. parts of the following triphenylamine compound

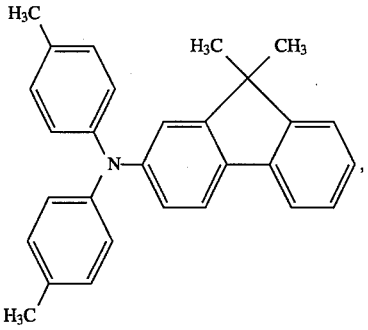

10 wt. parts of the following polycarbonate resin (bisphenol Z-based, molecular weight=$2\times10^4$),

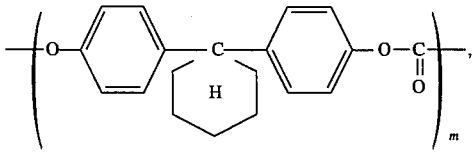

wherein m denotes an integer providing the indicated molecular weight, 50 wt. parts of monochlorobenzene and 15 wt. parts of dichloromethane were mixed under stirring to form a mixture liquid, which was then applied by dipping onto the above-formed charge generation layer and dried under blowing with hot air to form a 20 μm-thick charge transport layer.

Then, 3 wt. parts of true-spherical three-dimensionally crosslinked polysiloxane particles (Dav.=0.29 μm, mfd. by Toshiba Silicone K.K.), 4 wt. parts of the following polycarbonate resin (bisphenol Z-based, molecular weight=$8\times10^4$):

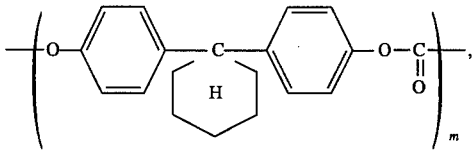

wherein m denotes an integer, 0.3 wt. part of the following polydimethylsiloxane methacrylate styrene block copolymer (molecular weight=$6\times10^4$ Si content=14wt. %) .

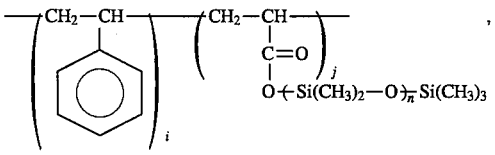

wherein i and j respectively denote an integer and n denotes an integer, 120 wt. parts of monochlorobenzene and 80 wt. parts of dichloromethane were subjected to mixing and dispersion in a sand mill to form a mixture liquid. To the mixture liquid, 3 wt. parts of the following triphenylamine

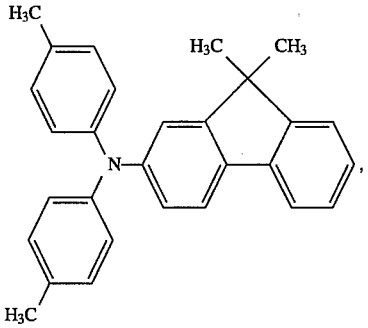

and a prescribed amount of $FeCl_3$ were further added and dissolved therein. The resultant mixture liquid was applied by spray coating onto the above-formed charge transport layer to form a 3 μm-thick protective layer, thereby providing a photosensitive drum J showing a surface layer Fe content of 0.2 ppm.

As a result of the XPS measurement, the photosensitive drum K showed Si atom content of 15.1 % C atom content of 70.3% and Si/C ratio of 0.215.

The F/C ratio and F/O ratio or the Si/C ratio and Si/O ratio, respectively as measured by XPS, of the outermost layers of the above-prepared photosensitive drum F–J are summarized in the following Tables 2 and 3.

TABLE 2

| Photosensitive drum | F/C ratio | F/O ratio |
|---|---|---|
| F | 0.064 | 0.097 |
| G | 0.133 | 0.378 |
| H | 0.150 | 0.574 |

TABLE 3

| Photosensitive drum | Si/C ratio | Si/O ratio |
|---|---|---|
| I | 0.147 | 0.255 |
| J | 0.215 | 0.724 |

EXAMPLE 5

A commercially available electrophotographic copying machine ("NP-1215", mfd. by Canon K.K.) was remodeled by replacing the photosensitive drum with the photosensitive drum F prepared in Production Example 6. The remodeled machine, after being loaded with a two-component type developer comprising the above-prepared polymerization toner F and a magnetic ferrite carrier coated with styrene-acrylate copolymer, was subjected to image formation, wherein an analog electrostatic image formed on the photosensitive drum F was developed with the two-component type developer according to the normal development scheme under application of an alternating bias onto the developing sleeve to form a toner image. The toner image on the photosensitive drum F was further transferred onto a regenerated paper of 64 g/m$^2$ (regarded as plain paper, A4-size) to form a yet-unfixed toner image. The drum surface after the transfer was subjected to blade cleaning by using a urethane rubber blade.

The thus formed unfixed toner images on the regenerated paper were subjected to a fixability test by passing through between a pair of fixing rollers including an teflon-coated upper roller and a silicone rubber-coated lower roller in a temperature-adjustable external fixing device under the conditions of a nip of 4.5 mm, a linear pressure of 0.6 kg/cm, a process speed of 90 mm/sec and varying temperatures at an increment of 5° C. in the range of 100°–230° C.

The fixability was tested by rubbing a fixed image with a lens cleaning paper ("DASPER", mfd. by Ozu Paper Co. Ltd.) under a load of 50 g/cm$^2$ and evaluated in terms of a fixing initiation temperature which was the lowest temperature providing a density lowering by the rubbing of below 10%. During the fixing test, the occurrence of offset was observed with eyes and evaluated in terms of a high temperature offset-free point which was the highest temperature at which offset was not observed with eyes.

Separately, by using the remodeled machine, a blank rotation of a developing sleeve as an accelerated durability test was performed at a sleeve peripheral speed of 200 mm/sec for 180 min. without tranferring a toner layer on the developing sleeve to the photosensitive drum, whereby the attachment force between the toner and the photosensitive drum was evaluated by image formation before and after the blank rotation (durability test).

More specifically, a transfer rate was calculated as a ratio between the amount of a toner transferred to a transfer paper and the amount of the toner on the photosensitive drum before the transfer, and the transfer rates were obtained before and after the durability test. Further, a transfer maintenance ratio was obtained as a ratio of the transfer rates after the before the durability test. The performance was evaluated according to the following standard:

o: A transfer maintenance rate of above 90% is retained as a ratio after and before the durability test.

Δ: A transfer maintenance rate of 80–90% is given.

x: A transfer maintenance rate of below 80% is given.

Incidentally, a toner shows a high transfer rate at an initial stage of continuous image formation because of an externally added flowability-improving agent, such as silica, but is liable to show a lower transfer rate with the continuation of image formation because such an external additive is gradually embedded within the toner particles, whereby an inherent attachment force acting between a toner and a photosensitive member is emphatically exhibited.

The results of the evaluation are shown in Table 4 appearing hereinafter.

EXAMPLES 6–9

The evaluation in Example 5 was repeated by using toners and photosensitive drums shown in Table 4, and the results thereof are also shown in Table 4 below.

TABLE 4**

| | Toner | | | | Fixability | | Image *5 | | Transfer characteristic | |
|---|---|---|---|---|---|---|---|---|---|---|
| | | Resin | | | | | forming | | | After *7 |
| Example | Name *1 | Polar resin* component (amount) | | Mp *2 on GPC | $T_{FI}$ *3 (°C.) | $T_{offset}$ *4 (°C.) | perfor-mance | Drum used | Initial *6 (%) | blank rotation |
| 5 | F | St-DMAEM | (8 g) | 20100 | 140 | 175 | excellent | H | 97 | o |
| 6 | G | St-AN | (7 g) | 19800 | 140 | 175 | " | G | 96 | o |
| 7 | 2 | St-DMAEM | (8 g) | 19500 | 140 | 175 | good | F | 95 | Δ |
| 8 | F | St-DMAEM | (8 g) | 20100 | 140 | 175 | " | I | 97 | Δ |
| 9 | F | St-DMAEM | (8 g) | 20100 | 140 | 175 | excellent | J | 96 | o |

*St-DMAEM represents styrene-dimethylaminoethyl methacrylate copolymer.
St-AN represents styrene-acrylonitrile copolymer.
**The other notes to Table 4 appear on the following page.
Other Notes to Table 4

TABLE 4**-continued

| | Toner | | | | | Image *5 | | Transfer characteristic | |
|---|---|---|---|---|---|---|---|---|---|
| | | Resin | | Fixability | | forming | | | After *7 |
| Example | Name *1 | Polar resin* component (amount) | Mp *2 on GPC | $T_{FI}$ *3 (°C.) | $T_{offset}$ *4 (°C.) | perfor-mance | Drum used | Initial *6 (%) | blank rotation |

*1: Toner 2 used in Example 7 alone was a pulverization toner and the other toners F and G were polymerization toners.
*2: Molecular weight at which the main peak in a GPC chromatogram was present.
*3: $T_{FI}$: The fixing initiation temperature.
*4: Toffset: The highest offset-free temperature.
*5: Overall evaluation with respect to the roughening at halftone parts, thin-line reproducibility and uniformity of solid part density, of images formed after the durability test.
*6: Transfer rate before the blank rotation (durability test).
*7: Evaluation of the transfer maintenance rate after the blank rotation (durability test).

What is claimed is:

1. An image forming method, comprising:

forming an electrostatic image on an electrophotographic photosensitive member, the electrophotographic photosensitive member comprising at least an electroconductive support, a charge generation layer and a charge transport layer, the electrophotographic photosensitive member having a surface layer containing a transition metal atom at 0.1–10 ppm, developing the electrostatic image to form a toner image on the electrophotographic photosensitive member, transferring the toner image onto a transfer-receiving medium, and removing a residual toner from the electrophotographic photosensitive member;

wherein the toner comprises at least a binder resin and a colorant, the binder resin comprising a resin component having a polar group, the binder resin having a molecular weight distribution according to gel permeation chromatography including a peak in a molecular weight region of $5\times10^3$–$5\times10^4$.

2. The image forming method according to claim 1, wherein the electrophotographic photosensitive member includes an outermost layer comprising a polycarbonate resin as a binder resin component.

3. The image forming method according to claim 2, wherein the polycarbonate resin has been synthesized from an asymmetrical diol.

4. The image forming method according to claim 1, wherein the electrophotographic photosensitive member includes an outermost layer comprising a fluorine-containing substance, and the outermost layer has a ratio of fluorine atom/carbon atom (F/C) of 0.03–1.00 as measured by X-ray photoelectron spectroscopy.

5. The image forming method according to claim 1, wherein the electrophotographic photosensitive member includes an outermost layer comprising a silicon-containing substance, and the outermost layer has a ratio of silicon atom/carbon atom (Si/C) of 0.03–1.00 as measured by X-ray photoelectron spectroscopy.

6. The image forming method according to claim 1, wherein the electrophotographic photosensitive member includes an outermost layer comprising a fluorine-containing substance and a silicon-containing substance, and the outermost layer has a ratio of fluorine atom/carbon atom (F/C) and a ratio of silicon atom/carbon atom (Si/C), respectively, of 0.03–1.00 as measured by X-ray photoelectron spectroscopy.

7. The image forming method according to claim 1, wherein the transition metal atom is a metal atom selected from the group consisting of iron, nickel, and chromium.

8. The image forming method according to claim 1, wherein the electrophotographic photosensitive member includes a surface layer which comprises a polycarbonate resin and contains iron atom.

9. The image forming method according to claim 8, wherein the polycarbonate resin has been synthesized from an asymmetrical diol.

10. The image forming method according to claim 1, wherein the electrophotographic photosensitive member includes a surface layer which comprises a polycarbonate resin and contains nickel atom.

11. The image forming method according to claim 10, wherein the polycarbonate resin has been synthesized from an asymmetrical diol.

12. The image forming method according to claim 1, wherein the electrophotographic photosensitive member includes a surface layer which comprises a polycarbonate resin and contains chromium atom.

13. The image forming method according to claim 12, wherein the polycarbonate resin has been synthesized from an asymmetrical diol.

14. The image forming method according to claim 1, wherein the electrophotographic photosensitive member includes an outermost protective layer comprising a polycarbonate resin as a binder resin.

15. The image forming method according to claim 14, wherein the protective layer contains a fluorine-containing organic compound, a silicon-contain organic compound, or a mixture thereof.

16. The image forming method according to claim 1, wherein the toner is a polymerization toner which has been directly produced by polymerization of a monomer composition in an aqueous medium.

17. The image forming method according to claim 1, wherein the toner is a pulverization toner.

18. The image forming method according to claim 16, wherein the toner contains a wax.

19. The image forming method according to claim 18, wherein the wax has a softening point of 40° to 130° C.

20. The image forming method according to claim 19, wherein the wax has a softening point of 50° to 120° C.

21. The image forming method according to claim 18, wherein the wax is contained in an amount of 0.1 to 50 wt. % of the toner.

22. The image forming method according to claim 16, wherein the monomer composition contains a wax and a polymer or copolymer having a polar group.

23. The image forming method according to claim 22, wherein the polar group is carboxyl group.

24. An image forming method comprising:

forming an electrostatic image on an electrophotographic photosensitive member, the electrophotographic photosensitive member comprising at least an electroconductive support, a charge generation layer and a charge transport layer, wherein the electrophotographic photosensitive member has a surface layer containing a transition metal atom at 0.1–10 ppm and an outermost layer comprising a fluorine-containing substance, and wherein the outermost layer has a ratio of fluorine atom/carbon atom of 0.03–1.00 as measured by X-ray photoelectron spectroscopy;

developing the electrostatic image to form a toner image on the electrophotographic photosensitive member;

transferring the toner image onto a transfer-receiving medium; and removing a residual toner from the electrophotographic photosensitive member;

wherein the toner is a polymerization toner which has been directly produced by polymerization of a monomer composition in an aqueous medium and the polymerization toner comprises at least a binder resin and a colorant, the binder resin comprising a resin component having a polar group, the binder resin having a molecular weight distribution according to gel permeation chromatography including a peak in a molecular weight region of $5\times10^3$–$5\times10^4$.

25. The image forming method according to claim 24, wherein the toner contains a wax.

26. The image forming method according to claim 25, wherein the wax has a softening point of 40° to 130° C.

27. The image forming method according to claim 26, wherein the wax has a softening point of 50° to 120° C.

28. The image forming method according to claim 25, wherein the wax is contained in an amount of 0.1 to 50 wt. of the toner.

29. The image forming method according to claim 24, wherein the monomer composition contains a wax and a polymer or copolymer having a polar group.

30. The image forming method according to claim 29, wherein the polar group is carboxyl group.

31. The image forming method according to claim 24, wherein the surface layer contains a polycarbonate resin as a binder resin component.

32. The image forming method according to claim 31, wherein the polycarbonate resin has been synthesized from an asymmetrical diol.

33. The image forming method according to claim 24, wherein the transition metal atom is a metal atom selected from the group consisting of iron, nickel and chromium.

34. The image forming method according to claim 24, wherein the outermost layer contains a fluorine-containing resin.

35. An image forming method comprising:

forming an electrostatic image on an electrophotographic photosensitive member, the electrophotographic photosensitive member comprising at least an electroconductive support, a charge generation layer and a charge transport layer, wherein the electrophotographic photosensitive member has a surface layer containing a transition metal atom at 0.1–10 ppm and an outermost layer comprising a silicon-containing substance, and wherein the outermost layer has a ratio of silicon atom/carbon atom of 0.03–1.00 as measured by X-ray photoelectron spectroscopy;

developing the electrostatic image to form a toner image on the electrophotographic photosensitive member;

transferring the toner image onto a transfer-receiving medium; and removing a residual toner from the electrophotographic photosensitive member;

wherein the toner is a polymerization toner which has been directly produced by polymerization of a monomer composition in an aqueous medium and the polymerization toner comprises at least a binder resin and a colorant, the binder resin comprising a resin component having a polar group, the binder resin having a molecular weight distribution according to gel permeation chromatography including a peak in a molecular weight region of $5\times10^3$–$5\times10^4$.

36. The image forming method according to claim 35, wherein the toner contains a wax.

37. The image forming method according to claim 36, wherein the wax has a softening point of 40° to 130° C.

38. The image forming method according to claim 37, wherein the wax has a softening point of 50° to 120° C.

39. The image forming method according to claim 36, wherein the wax is contained in an amount of 0.1 to 50 wt. % of the toner.

40. The image forming method according to claim 35, wherein the monomer composition contains a wax and a polymer or copolymer having a polar group.

41. The image forming method according to claim 40, wherein the polar group is carboxyl group.

42. The image forming method according to claim 35, wherein the surface layer contains a polycarbonate resin as a binder resin component.

43. The image forming method according to claim 42, wherein the polycarbonate resin has been synthesized from an asymmetrical diol.

44. The image forming method according to claim 35, wherein the transition metal atom is a metal atom selected from the group consisting of iron, nickel and chromium.

* * * * *

UNITED STATES PATENT AND TRADEMARK OFFICE

CERTIFICATE OF CORRECTION

PATENT NO. : 5,480,759

DATED : January 2, 1996

INVENTOR(S) : TAKASHIGE KASUYA ET AL.

It is certified that error appears in the above-identified patent and that said Letters Patent is hereby corrected as shown below:

COLUMN 1

Line 63, "having purpose" should read --having excellent durability has been desired. For that purpose.

COLUMN 2

Line 51, "excepted" should read --expected--.

COLUMN 3

Line 23, "transparent" should read -transport--.

COLUMN 7

Line 8, "00.001-01 wt. %" should read --0.001-0.1 wt. %--.
Line 23, "Navel" should read --Naval--.
Line 37, "hydrophobise" should read --hydrophobize--.
Line 46, "in" should be deleted.

UNITED STATES PATENT AND TRADEMARK OFFICE

CERTIFICATE OF CORRECTION

PATENT NO. : 5,480,759

DATED : January 2, 1996

INVENTOR(S) : TAKASHIGE KASUYA ET AL.

It is certified that error appears in the above-identified patent and that said Letters Patent is hereby corrected as shown below:

COLUMN 13

Line 35, "seleniumtellurium," should read --selenium-tellurium,--.
Line 49, "-aα-" should read -- -α- --.
Line 50, "drazoe," should read --drazone,--.
Line 59, "dethylaminophenyl)" should read --diethylaminophenyl)--.
Line 64, "(ⓐ-" should read --(p- --.

COLUMN 15

Line 25, "allowed" should read --configured--.
Line 66, "fluorine containing" should read --fluorine-containing--.

COLUMN 17

Line 4, "ultrahigh" should read --ultra-high--.

COLUMN 18

Line 62, "an" should read --and--.

UNITED STATES PATENT AND TRADEMARK OFFICE

CERTIFICATE OF CORRECTION

PATENT NO. : 5,480,759

DATED : January 2, 1996

INVENTOR(S) : TAKASHIGE KASUYA ET AL.

It is certified that error appears in the above-identified patent and that said Letters Patent is hereby corrected as shown below:

COLUMN 19

Line 64, "as" should read --was--.
Line 65, "aboveprepared" should read --above-prepared--.

COLUMN 21

Line 13, "in" should be deleted.

COLUMN 22

Line 3, "Protective" should read --protective--.
Line 30, "m" should read --i--.
Line 66, "i" should read --in--.

COLUMN 24

Line 20, "test of" should read --test was conducted for--.
Line 25, "in" should be deleted.
Table 1*, "*Notes to the above table appear on the following page" should be deleted, and "*6: Toffset" should read --*6: $T_{offset}$--.

UNITED STATES PATENT AND TRADEMARK OFFICE

CERTIFICATE OF CORRECTION

PATENT NO. : 5,480,759

DATED : January 2, 1996

INVENTOR(S) : TAKASHIGE KASUYA ET AL.

It is certified that error appears in the above-identified patent and that said Letters Patent is hereby corrected as shown below:

COLUMN 25

Line 17, "1200 rpm" should read --12000 rpm--.

COLUMN 26

Line 53, "as" should read --was--.

COLUM 31

Line 32, "layer. Then" should read --layer. ¶ Then--.
Line 33, "(Dav.)" should read --(Dav.--.

COLUMN 32

Line 46, "Protective" should read --protective--.
Line 65, "weight=5x10⁴" should read --weight=5x10⁴,--.

COLUMN 33

Line 4, "$-(CH_2-CH)-$" should read -- $-(CH_2-C)-$ --.

UNITED STATES PATENT AND TRADEMARK OFFICE

CERTIFICATE OF CORRECTION

PATENT NO. : 5,480,759

DATED : January 2, 1996

INVENTOR(S) : TAKASHIGE KASUYA ET AL.

It is certified that error appears in the above-identified patent and that said Letters Patent is hereby corrected as shown below:

COLUMN 34

Line 30, "weight=6x10⁴" should read --weight=6x10⁴,--.

Line 33, " 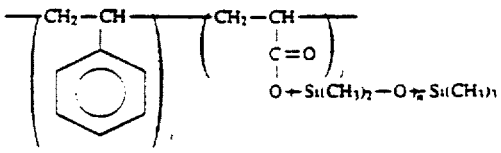 " should read

-- 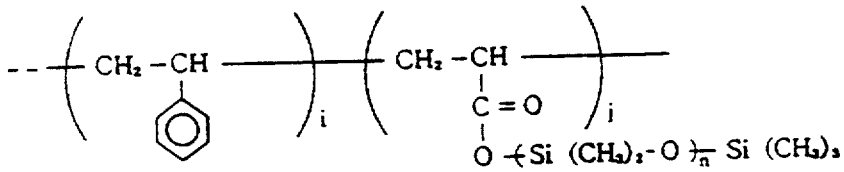 --.

Line 66, "15.1%" should read --15.1%,--.

COLUMN 35

Line 3, "drum F-J" should read --drums F-J--.

Line 45, "an" should read --a--.

COLUMN 36

Line 26, "after the before" should read --before and after--.

UNITED STATES PATENT AND TRADEMARK OFFICE

CERTIFICATE OF CORRECTION

PATENT NO. : 5,480,759

DATED : January 2, 1996

INVENTOR(S) : TAKASHIGE KASUYA ET AL.

It is certified that error appears in the above-identified patent and that said Letters Patent is hereby corrected as shown below:

COLUMN 37

Line Table 4**-continued,
"*4: Toffset:" should read --*4: $T_{offset}$:--.

Signed and Sealed this

Twenty-fifth Day of June, 1996

*Attest:*

*Attesting Officer*

BRUCE LEHMAN

*Commissioner of Patents and Trademarks*